US011312546B2

(12) United States Patent
Smaldone et al.

(10) Patent No.: US 11,312,546 B2
(45) Date of Patent: Apr. 26, 2022

(54) CONTAINER WITH AUTOMATIC LID CLOSURE

(71) Applicant: AFJ INDUSTRIES LLC, Rahway, NJ (US)

(72) Inventors: Al Smaldone, Brooklyn, NY (US); Daniel Gatto, Brooklyn, NY (US); James Smaldone, Brooklyn, NY (US)

(73) Assignee: AFJ Industries, LLC, Rahway, NJ (US)

( * ) Notice: Subject to any disclaimer, the term of this patent is extended or adjusted under 35 U.S.C. 154(b) by 394 days.

(21) Appl. No.: 15/807,374

(22) Filed: Nov. 8, 2017

(65) Prior Publication Data

US 2018/0127165 A1 May 10, 2018

Related U.S. Application Data

(60) Provisional application No. 62/460,388, filed on Feb. 17, 2017, provisional application No. 62/419,173, filed on Nov. 8, 2016.

(51) Int. Cl.
*B65D 45/02* (2006.01)
*B65D 47/24* (2006.01)
(Continued)

(52) U.S. Cl.
CPC ..... *B65D 45/025* (2013.01); *A45F 3/18* (2013.01); *B65D 43/26* (2013.01); *B65D 47/243* (2013.01);
(Continued)

(58) Field of Classification Search
CPC .. B65D 45/025; B65D 43/0202; B65D 43/26; B65D 47/248; B65D 2313/04; H01F 7/0252; Y10S 428/90
(Continued)

(56) References Cited

U.S. PATENT DOCUMENTS 5,947,343 A 9/1999 Horstmann
7,172,101 B2 * 2/2007 Find ..... A47J 41/0005 220/230
(Continued)

FOREIGN PATENT DOCUMENTS

CN 101945812 1/2011
FR 955903 * 11/1947
WO 2009/014378 1/2009

*Primary Examiner* — Anthony D Stashick
*Assistant Examiner* — Raven Collins
(74) *Attorney, Agent, or Firm* — Fay Kaplun & Marcin, LLP

(57) ABSTRACT

A drinking container includes an automatically opening and closing magnetic lid. The drinking container includes a container portion, a sleeve, and a lid. The sleeve is moveable between a closed position and an open position with respect to the container portion, the sleeve including a sleeve magnet. The lid is moveable from a closed configuration to an open configuration, the lid including a lid magnet, the closed configuration of the lid sealing an access pathway to an interior of the container portion, the open configuration of the lid opening the access pathway to the interior of the container portion. In the closed position of the sleeve, a biased force holds the lid in the closed configuration. In the open position of the sleeve, the sleeve magnet and the lid magnet have a magnetic force greater than the biased force to place the lid in the open configuration.

17 Claims, 14 Drawing Sheets

(51) Int. Cl.

| | |
|---|---|
| ***B65D 43/26*** | (2006.01) |
| ***B65D 55/14*** | (2006.01) |
| ***B65D 51/16*** | (2006.01) |
| ***A45F 3/18*** | (2006.01) |
| ***B65D 51/24*** | (2006.01) |
| ***B65D 85/72*** | (2006.01) |

(52) U.S. Cl.
CPC ..... *B65D 51/1644* (2013.01); *B65D 51/1683* (2013.01); *B65D 51/245* (2013.01); *B65D 55/14* (2013.01); *B65D 85/72* (2013.01); *B65D 2543/005* (2013.01); *B65D 2543/00046* (2013.01); *B65D 2543/00092* (2013.01); *B65D 2543/00277* (2013.01); *B65D 2543/00296* (2013.01); *B65D 2543/00314* (2013.01); *B65D 2543/00537* (2013.01); *B65D 2543/00555* (2013.01)

(58) Field of Classification Search
USPC ..... 220/230, 327, 324, 315
See application file for complete search history.

(56) References Cited

U.S. PATENT DOCUMENTS

| | | | | |
|---|---|---|---|---|
| 7,451,627 | B2 * | 11/2008 | Horngren | E05B 73/0023 206/1.5 |
| 7,513,380 | B2 | 4/2009 | Canedo | |
| 7,546,933 | B2 | 6/2009 | Pinelli | |
| 8,272,532 | B2 | 9/2012 | Michaelian et al. | |
| 8,317,048 | B2 | 11/2012 | Hajichristou et al. | |
| 9,093,206 | B2 * | 7/2015 | Davis | B65D 43/0202 |
| 2007/0170184 | A1 | 7/2007 | Canedo | |
| 2013/0119060 | A1 | 5/2013 | Chiou et al. | |
| 2014/0034080 | A1 * | 2/2014 | Paquet | B65D 43/26 132/286 |
| 2016/0000245 | A1 * | 1/2016 | Sims | B65D 43/02 220/253 |
| 2016/0030286 | A1 * | 2/2016 | Fazi | B65D 53/02 220/230 |
| 2016/0264320 | A1 * | 9/2016 | Meyers | B65D 45/025 |
| 2016/0318669 | A1 | 11/2016 | Morewitz et al. | |

* cited by examiner

CONTAINER WITH AUTOMATIC LID CLOSURE

PRIORITY INFORMATION

The present application claims priority to U.S. Provisional Patent Application Ser. No. 62/419,173 filed on Nov. 8, 2016 entitled "Container with Automatic Lid Closure" naming Al Smaldone, James Smaldone, and Daniel Gatto as inventors, as well as claims priority to U.S. Provisional Patent Application Ser. No. 62/460,388 filed on Feb. 17, 2017 entitled "Container with Automatic Lid Closure" naming Al Smaldone, James Smaldone, and Daniel Gatto as inventors, and hereby incorporates, by reference, the entire subject matter of these U.S. Provisional Patent Applications.

BACKGROUND INFORMATION

A drinking container may provide a vessel in which a user may store a beverage. There are a variety of different types of drinking containers that are available. For example, a mug made of ceramic may hold a beverage for consumption. However, the mug may be relatively fragile and not suited for travel. In another example, a stainless steel mug may hold a beverage for consumption. Although more durable, the mug may be susceptible to spills or other actions that cause the beverage to inadvertently fall out of the drinking container. Accordingly, the drinking container may include further features that allow the beverage to be maintained in the drinking container in a more secure manner. For example, the drinking container may include a lid that is fastened using any of a variety of coupling mechanisms (e.g., friction fit, threading, etc.).

To drink the beverage, the lid may be required to be uncoupled from the drinking container. However, this type of lid may be burdensome and may make it difficult to drink the beverage. Thus, the lid may also include a feature that allows the lid to remain coupled to the drinking container but still allow a user to drink from the drinking container. For example, the lid may include a sealing feature to provide or prevent access to the beverage. In a particular example, the lid may include a hinged cover that is placed over a spout. Thus, when the cover is removed from the spout to unseal the lid, the beverage is accessible. In another example, the lid may include a manual trigger or gravity biased trigger that provides access to the beverage once actuated to unseal the lid. Although these lids with the sealing feature may provide increased spill prevention, these lids are still prone to inadvertent spills, particularly when the sealing feature is misused or the drinking container is positioned/oriented in a way that prevents the sealing feature from properly providing its sealing functionality. Even if a lock feature were to be added that keeps the lid sealed, users often overlook this feature and do not actively use it. Furthermore, these lids may be cumbersome without a seamless mechanism to provide or prevent access to the beverage. That is, conventional lids do not provide both an automatic opening and closing mechanism.

SUMMARY

The exemplary embodiments are directed to a drinking container, comprising: a container portion; a sleeve that is moveable between a closed position and an open position with respect to the container portion, the sleeve including a sleeve magnet; and a lid that is moveable from a closed configuration to an open configuration, the lid including a lid magnet, the closed position of the sleeve corresponding to the closed configuration of the lid sealing an access pathway to an interior of the container portion, the open position of the sleeve corresponding to the open configuration of the lid opening the access pathway to the interior of the container portion, wherein, in the closed position of the sleeve, a biased force holds the lid in the closed configuration, wherein, in the open position of the sleeve, the sleeve magnet and the lid magnet have a magnetic force greater than the biased force to place the lid in the open configuration.

The exemplary embodiments are directed to a drinking container, comprising: a container portion; a sleeve that is moveable between a closed position and an open position with respect to the container portion, the sleeve including a sleeve magnet; and a lid that is moveable from a closed configuration to an open configuration, the lid including a lid magnet, the closed position of the sleeve corresponding to the closed configuration of the lid sealing an access pathway to an interior of the container portion, the open position of the sleeve corresponding to the open configuration of the lid opening the access pathway to the interior of the container portion, the lid including a lid upper and a lid lower, the lid lower being separated from the lid upper in the open configuration, the lid lower being held against the lid upper in the closed configuration, wherein, in the closed position of the sleeve, a spring force biases the lid in the closed configuration, wherein, in the open position of the sleeve, the sleeve magnet and the lid magnet have a magnetic force greater than the biased force to place the lid in the open configuration.

The exemplary embodiments are directed to a drinking container, comprising: a container portion; a sleeve that is moveable between a closed position and an open position with respect to the container portion, the sleeve including a sleeve magnet; and a lid that is moveable from a closed configuration to an open configuration, the lid including a lid magnet and a lever magnet disposed at a first free end of a lever, a second hinged end of the lever coupled to the lid, the closed position of the sleeve corresponding to the closed configuration of the lid sealing an access pathway to an interior of the container portion, the open position of the sleeve corresponding to the open configuration of the lid opening the access pathway to the interior of the container portion, the lever being held with the lid in the closed configuration while the sleeve is in the closed position, the first free end of the lever being pivoted away from the lid while the sleeve is in the open position, wherein, in the closed position of the sleeve, a biased force holds the lid in the closed configuration, wherein, in the open position of the sleeve, the sleeve magnet and the lid magnet have a magnetic force greater than the biased force to place the lid in the open configuration.

DETAILED DESCRIPTION

Figure 1:
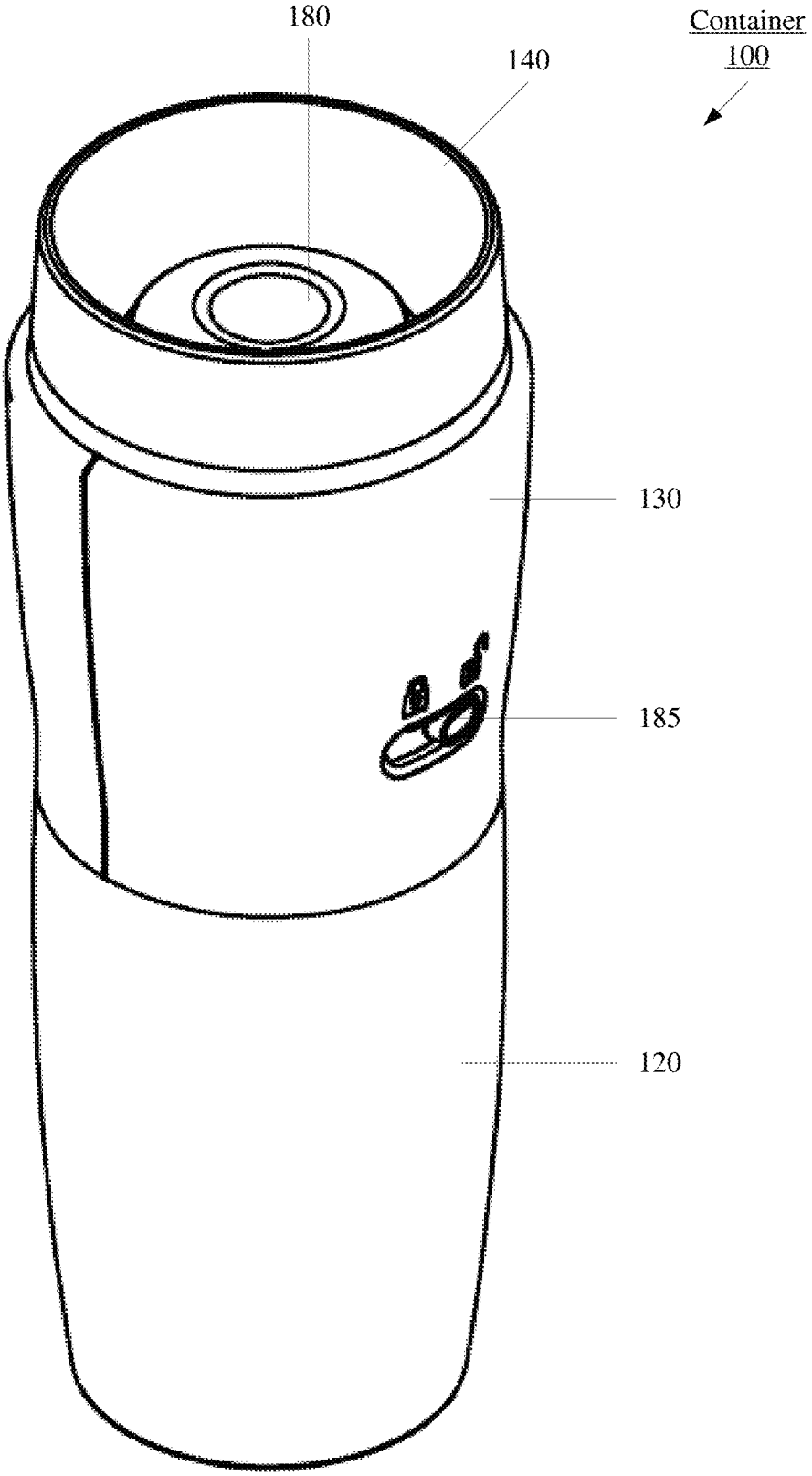
FIG. 1 shows a perspective view of an example first container according to the exemplary embodiments.

The exemplary embodiments may be further understood with reference to the following description and the related appended drawings, wherein like elements are provided with the same reference numerals. The exemplary embodiments describe a drinking container with a lid that seamlessly provides access to a liquid being held in the drinking container. As will be described in detail below, the lid may be configured with a mechanism that automatically opens and closes the lid. Specifically, when a user raises the drinking container, the lid may be automatically opened while when the user places the drinking container on a surface, the lid may be automatically closed. The mechanism according to the exemplary embodiments utilizes a magnetic feature to open the lid and provide access to an interior of the drinking container. The exemplary embodiments may also provide a venting feature to release pressure within the interior of the drinking container and an indicator feature that cooperates with the lid to indicate when the lid is open or closed.

It should be noted that the exemplary embodiments are described with regard to a beverage or drinking container and a beverage or liquid being held therein. However, the container being used for liquids is only exemplary and it should be understood that the drinking container may represent any container in which an item is placed within the container and kept in the container until a decision is made by a user to remove at least some of the item. For example, the container may also hold solids (e.g., food), gases, a combination thereof, etc.

The exemplary embodiments provide a drinking container that may be opened manually by a user while remaining closed at other times. From raising the drinking container, the opening mechanism may automatically open an access pathway for the user to drink a liquid being held in the drinking container. The drinking container may also automatically close when not being held by the user from a biasing feature of the opening mechanism. The drinking container according to the exemplary embodiments may include a magnetic feature to reposition components that result in the drinking container to be opened and/or closed. Specifically, the magnetic feature may pull a component of a lid of the drinking container from a resting position to a stressed position against a bias so that the drinking container is open allowing access to a beverage via an access pathway (e.g., a spout). According to a first exemplary embodiment, a first container may utilize the magnetic feature with a spring feature. According to a second exemplary embodiment, a second lid may utilize the magnetic feature with a lever feature. According to a third exemplary embodiment, a third lid may utilize the magnetic feature with a further magnetic feature.

Figure 2:
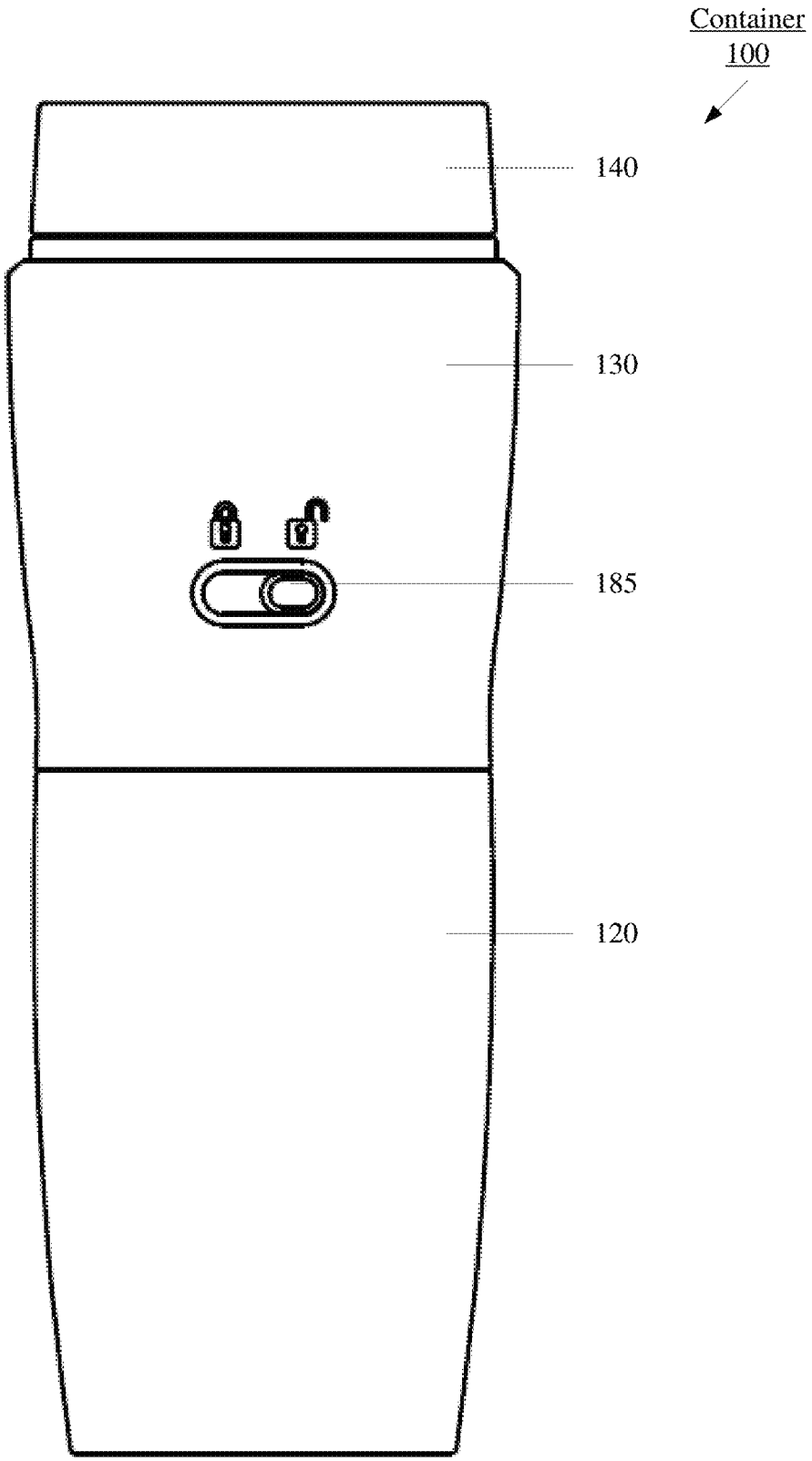
FIG. 2 shows a side view of the example first container of FIG. 1 according to the exemplary embodiments.
Figure 3:
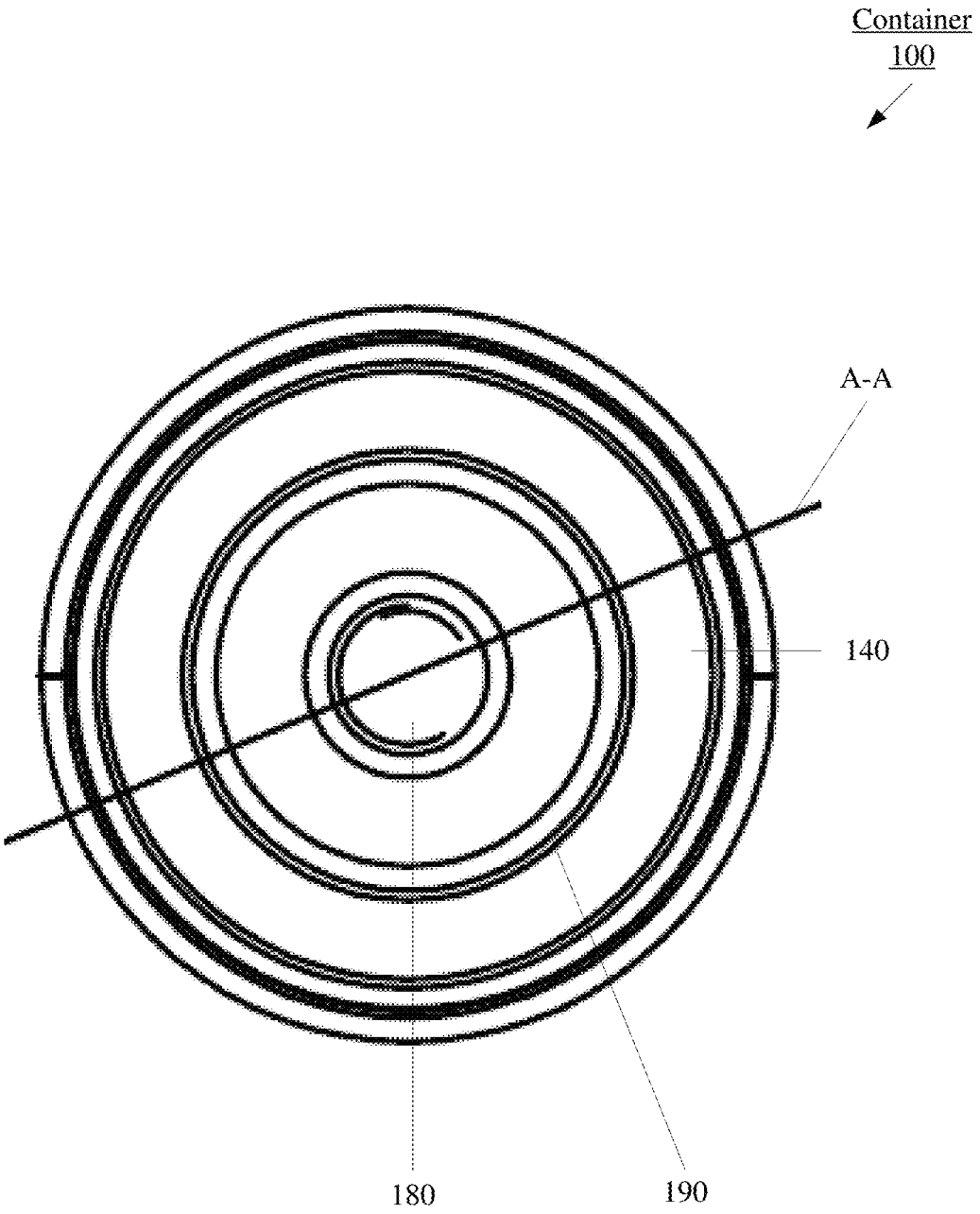
FIG. 3 shows a top view of the example first container of FIG. 1 according to the exemplary embodiments.
Figure 4:
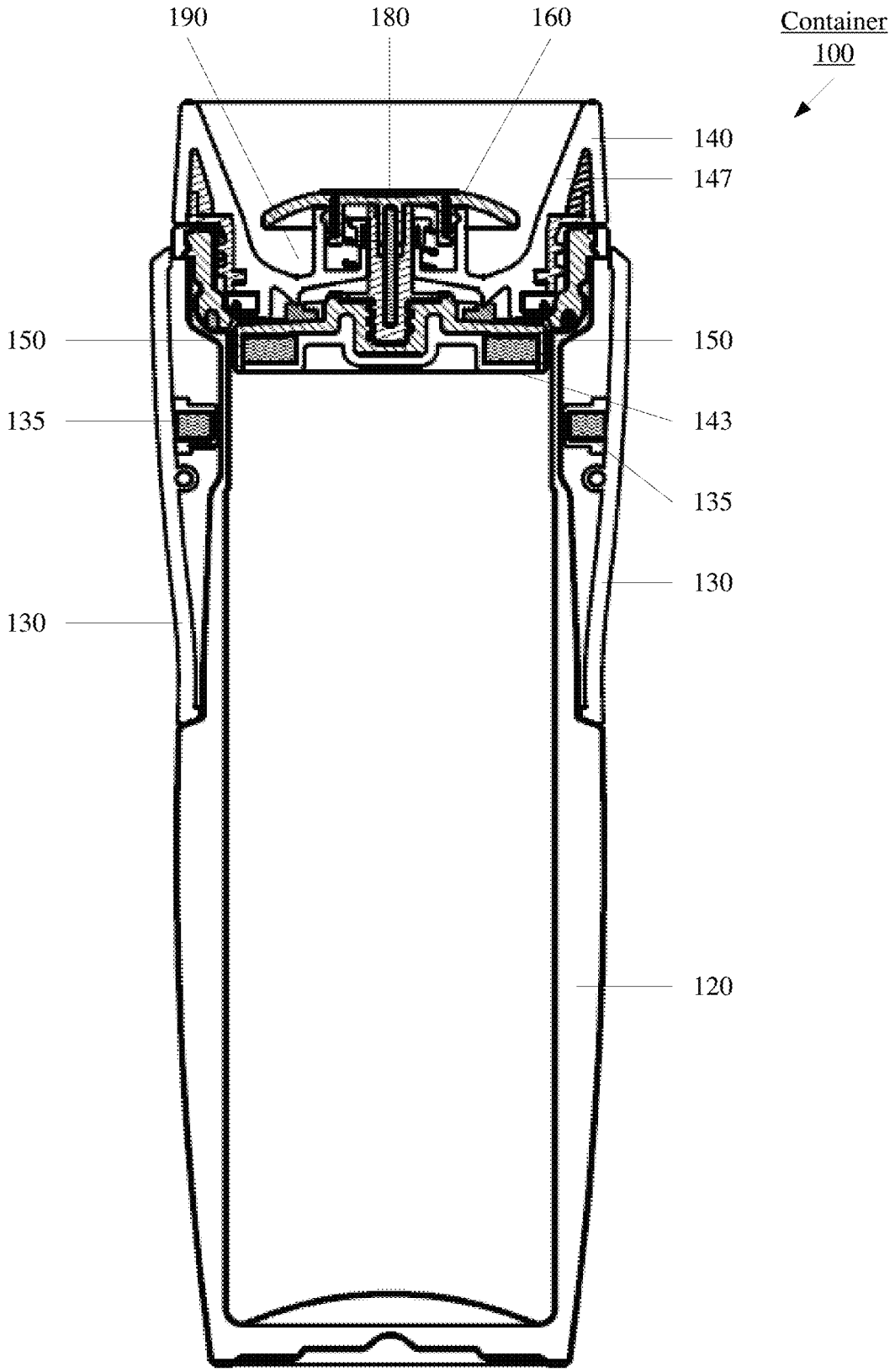
FIG. 4 shows a first cross-sectional view of the example first container of FIG. 1 according to the exemplary embodiments.
Figure 5:
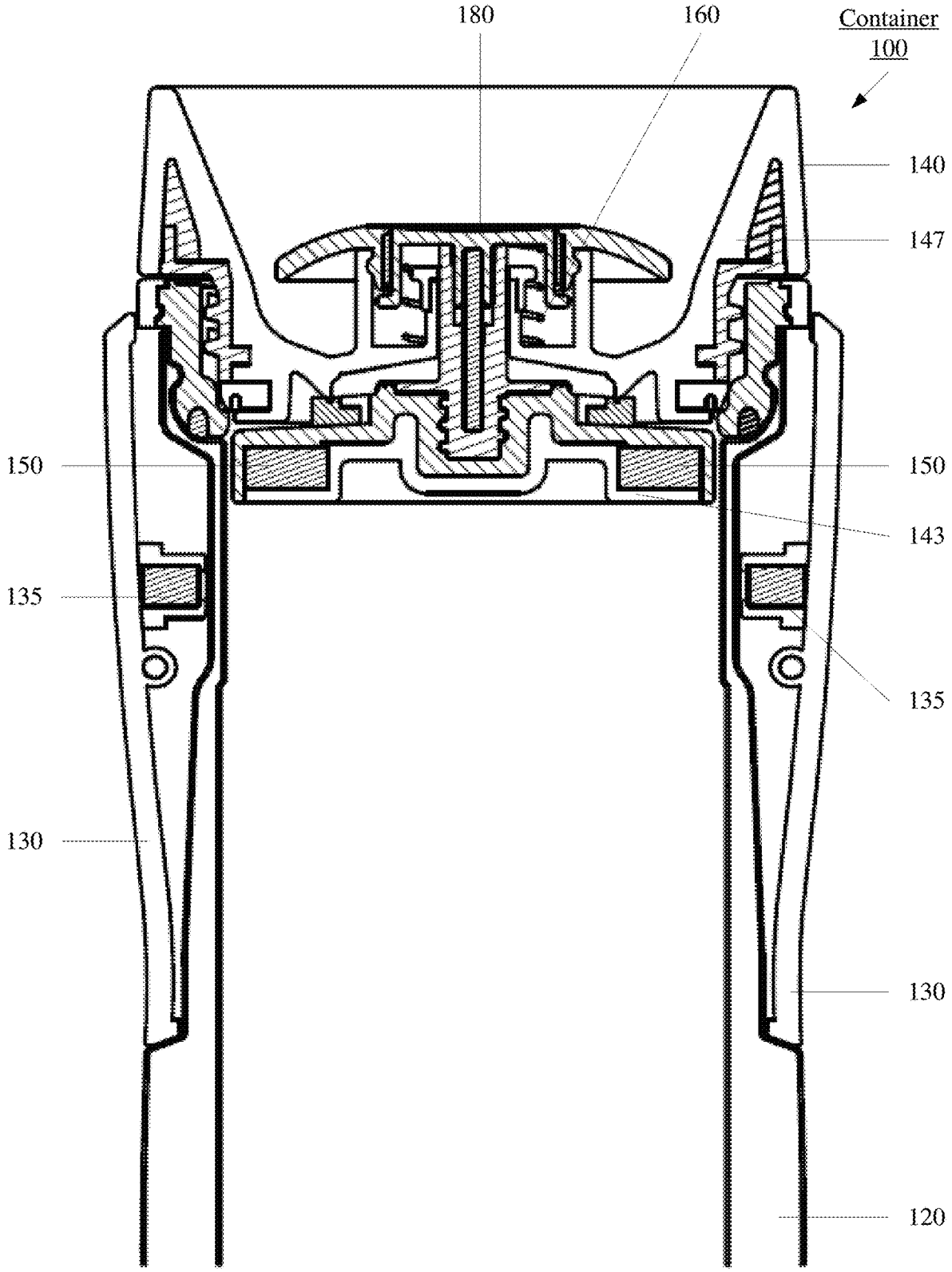
FIG. 5 shows a second cross-sectional view of the example first container of FIG. 1 according to the exemplary embodiments.
Figure 6:
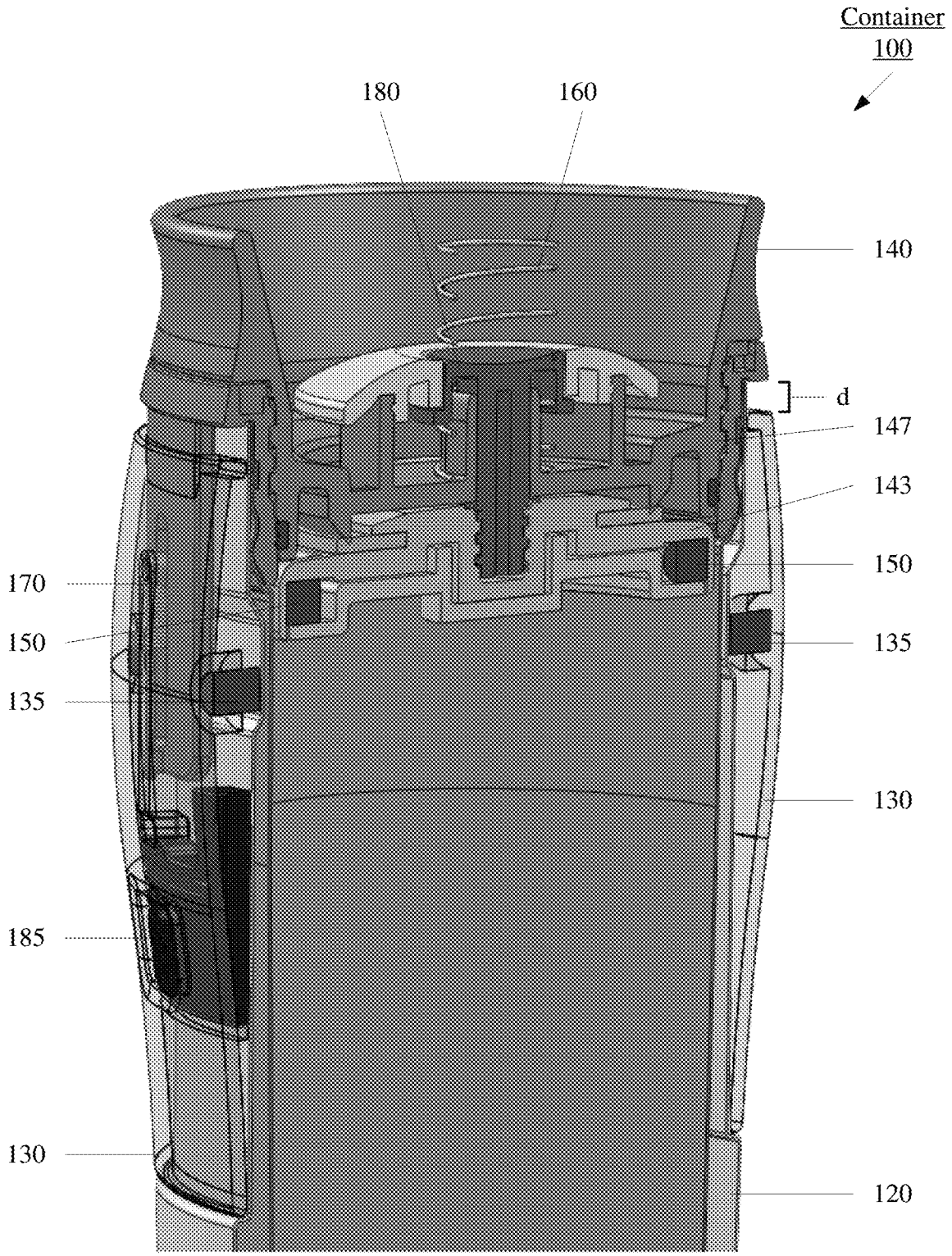
FIG. 6 shows a third cross-sectional view of the example first container of FIG. 1 according to the exemplary embodiments.
Figure 7:
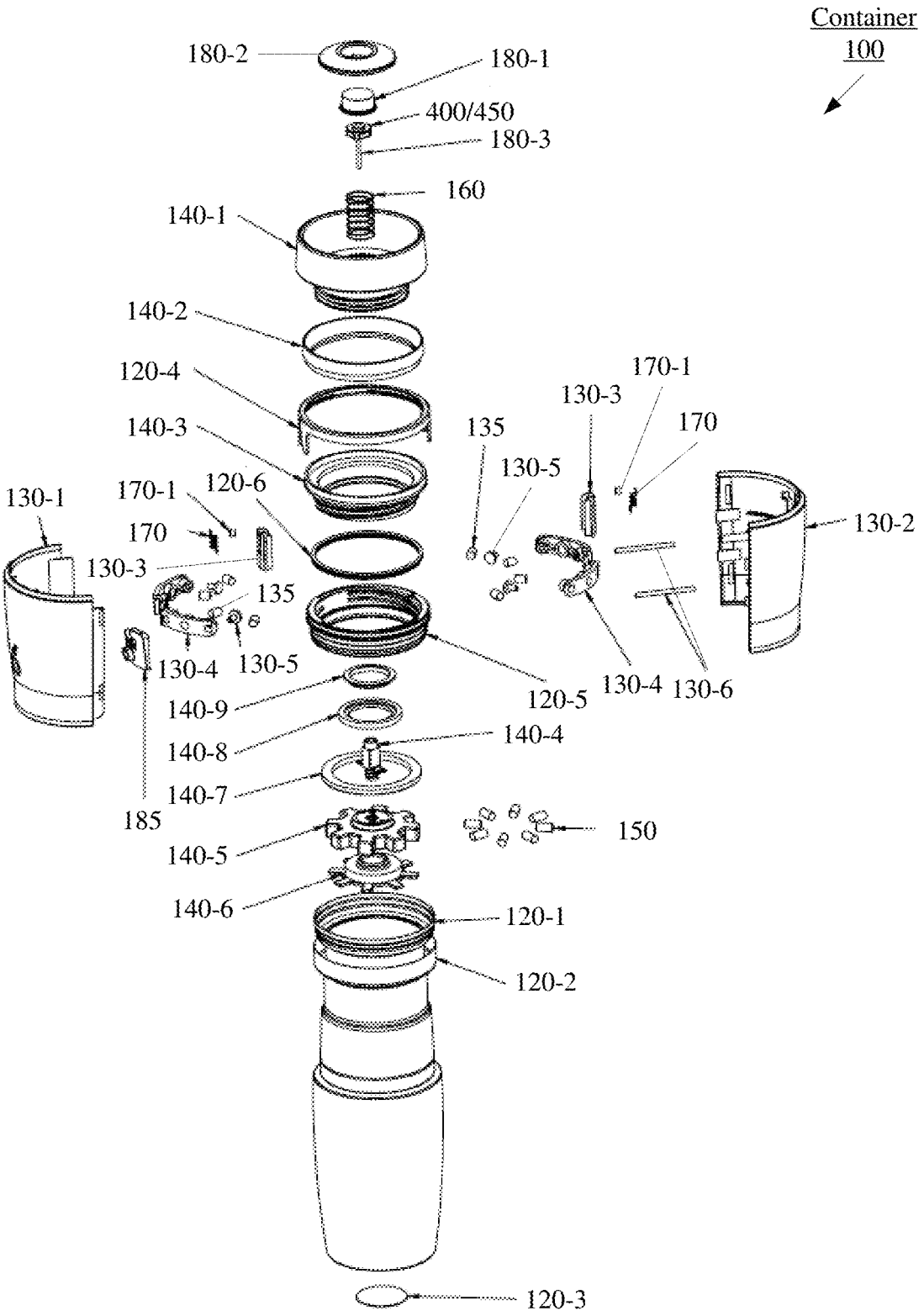
FIG. 7 shows a deconstructed view of the example first container of FIG. 1 according to the exemplary embodiments.

FIGS. 1-7 show different perspectives of an example first container 100 according to the exemplary embodiments. Specifically, FIG. 1 shows a perspective and assembled view, FIG. 2 shows a side and assembled view, FIG. 3 shows a top and assembled view, FIG. 4 shows a first cross-sectional and side view, FIG. 5 shows a second cross-sectional and enlarged side view, FIG. 6 shows a third cross-sectional and enlarged perspective view, and FIG. 7 shows a deconstructed view of the example first container 100.

The first container 100 may include a plurality of components and sub-components. Generally, the first container 100 may include a container portion 120, a sleeve 130 positioned around a periphery of the container portion 120 along a section of a longitudinal length, and a lid 140 positioned at a top end of the container portion 120. Initially, it is noted that the first container 100 exhibiting a cylindrical shape as shown in FIG. 1 is only exemplary. The first container 100 may have any shape longitudinally and/or laterally without departing from the scope of the exemplary embodiments. For example, the drinking container 100 may exhibit any longitudinal shape (e.g., cone-like or tapering, polygonal, etc.) and/or have any lateral cross-sectional shape (e.g., circular, polygonal, etc.).

As noted above, FIG. 1 shows the container portion 120, the sleeve 130, and the lid 140. FIG. 1 also shows that the first container 100 may include a button 180 and a lock 185. As will be described in detail below, the button 180 and the lock 185 may be features that are manually controlled to provide a corresponding effect. The button 180 may additionally be associated with the opening mechanism with the magnetic feature as well as with an indicator. FIG. 2 shows a different perspective of the lock 185. As shown, the lock 185 may allow a user to lock the sleeve 130 into a position along the longitudinal length of the container portion 120. As will be described in detail below, at a first end of a moveable length, the first container 100 may be closed. At an opposite, second end of the moveable length, the first container 100 may be open. The lock 185 may be used (e.g., by sliding to a locked or unlocked setting) to keep the first container 100 in the open or closed configuration. Thus, if the lock 185 is in a locked setting while the sleeve 130 is at the first end, the lock 185 may keep the first container 100 in the closed configuration and prevent liquid from flowing out of the first container 100. If the lock 185 is then unlocked and moved to the unlocked setting while the sleeve 130 is at the first end, the sleeve 130 is capable of being moved to the second end and place the first container 100 in the open configuration. If the lock 185 is in a locked setting while the sleeve 130 is at the second end, the lock 185 may keep the first container 100 in the open configuration and allow liquid from flowing out of the first container 100. If the lock 185 is then unlocked and moved to the unlocked setting while the sleeve 130 is at the second end, the sleeve 130 is capable of being moved to the first end and place the first container 100 in the closed configuration. The lock 185 may be used for a variety of reasons. For example, while the first container 100 is being carried (e.g., in a bag), the first container 100 may become inadvertently opened. However, if the lock 185 is activated to maintain the closed position, the first container 100 may remain sealed until the lock 185 is disabled and the opening mechanism is actuated.

FIG. 3 shows a different perspective of the top of the first container 100 with the lid 140 and the button 180. Again, the circular cross-sectional shape and the concentric organization of the components is only exemplary. FIG. 3 also shows a line A-A that forms the basis of illustrating the cross-section of the first container 100. The top view of the first container 100 also illustrates a first exemplary embodiment of an access pathway of the lid 140. In the first exemplary embodiment, the access pathway may be a circular spout 190. Specifically, the circular spout 190 may be an access located between the button 180 and a top, concave surface of the lid 140. The circular spout 190 may provide a 360° approach for the user. Accordingly, the user may raise the first container 100 at any radial angular orientation without concern that a proper handling of the first container 100 is used to drink the beverage while the first container 100 is in the open configuration. As will be described in further detail below, the circular spout 190 may be closed when the first container 100 is in the closed configuration and the circular spout 190 may be opened when the first container 100 is in the open configuration. In a second exemplary embodiment, the access pathway may be other types of accesses such as a linear spout, a tube or straw spout, etc. The first container 100 may be configured to block or open the accesses depending on the configuration that the first container 100 is placed.

FIGS. 4-6 show different cross-sectional views of the first container 100. Since the perspective angle of the cross-sectional view of FIG. 6 shows a further component, the following is described with regard to this depiction. As shown in FIG. 6, the container portion 120, the sleeve 130, the lid 140, the button 180, and the lock 185 are again shown. The perspective view also shows a relative orientation and position of these components. For example, as noted above, the sleeve 130 may be posited on an exterior of the container portion 120 and along a periphery for a portion of a longitudinal length of the container portion 120. The sleeve 130 may also be configured to be moved along the longitudinal length of the container portion 120. As shown, the first container 100 may be in a closed configuration with the sleeve 130 at a first end of a moveable length. The sleeve 130 may move to a second end of the moveable length. For example, the sleeve 130 may be moved upwards along the longitudinal length of the container portion 120. Specifically, there may be a clearance for the sleeve 130 to be moved a distance d (e.g., 5.5 mm) to place the first container 100 in an open configuration. The lid 140 is also shown with a bottom portion being received in a top portion of the container portion 120. A coupling mechanism may be used for the lid 140 to be held together with the container portion 120. A relative position of the button 180 is also shown. For example, the button 180 may have an exposed surface at the top side of the first container 100 with a remaining portion extending into an interior of the lid 140. The perspective view also shows the lock 185 of the first container 100. The lock 185 may be a physical lock where sliding of a user actuated component translates to a locking piece being moved that prevents the sleeve 130 from being moved in a particular direction (e.g., prevent moving down when locked in an upward position or vice versa).

According to the first container 100, a seal spring 160 may bias the first container 100 to the closed configuration. Specifically, the lid 140 may be a multi-piece component including a lid lower 143 and a lid upper 147. When a top surface of the lid lower 143 is held against a bottom surface of the lid upper 147, an access pathway from the interior of the first container 100 to an exterior may be sealed. When the lid lower 143 is separated from the lid upper 147, the access pathway may be opened and the first container 100 may be in the open configuration. It is noted that the top of the seal spring 160 is not shown in its actual position, but is shown above the central portion of the lid 140 for illustrative purposes. The entirety of seal spring 160 will be inside the lid 140 as was shown in the assembled views of FIGS. 1-3. Specifically, the seal spring 160 may be held between a bottom surface of a top portion of the button 180 and a top surface of the lid upper 147.

With regard to the opening mechanism, the lid 140 may include a set of lid magnets 150. For example, the lid magnets 150 may include a plurality of single round magnets with a hollow center. In a specific implementation, there may be eight individual lid magnets 150 arranged longitudinally toward a cross-sectional center of the first container 100 and perpendicular to the longitudinal length of the first container 100. However, it is noted that the type, number, and orientation of the lid magnets 150 is only exemplary. In another exemplary embodiment, the lid magnets 150 may be a single circular magnet having a perimeter corresponding to a perimeter of an interior cross-section of the first container 100.

The lid magnets 150 may be configured to operate with a set of sleeve magnets 135. The sleeve magnets 135 may be substantially similar to the lid magnets 150 in type, number, and orientation, and may also be aligned along a longitudinal line. However, it is noted that the sleeve magnets 135 may also be of any type, number, and orientation so long as the attractive forces are achievable as described below. When the sleeve magnets 135 are moved to a position where the magnetic fields of the sleeve magnets 135 attract the magnetic fields of the lid magnets 150, the first container 100 is moved from the closed configuration to the open configuration. Specifically, when the sleeve 130 slides in the upward direction (e.g., from a user picking up the first container 100), the sleeve magnets 135 may be moved closer to the lid magnets 150. Again, the sleeve magnets 135 may be moved the distance d. When moved to this position, the attractive forces between the sleeve magnets 135 and the lid magnets 150 may overcome a bias of the seal spring 160 and cause the lid lower 143 to move in the downward direction, thereby separating the lid lower 143 from the lid upper 147 and causing the lid 140 to be unsealed and the user to be able to drink from the first container 100. It is noted that the distance d may be selected such that the sleeve magnets 135 remain under the lid magnets 150 even in a highest position. In this manner, the attractive forces may cause the lid lower 143 to move downward as the lid magnets 150 want to move toward the sleeve magnets 135.

As noted above, the seal spring 160 may bias the lid lower 143 to be held against the lid upper 147. For example, the button 180 may extend through the lid upper 147 in a slidable manner in an aperture therethrough while coupled to the lid lower 143. As noted above, the seal spring 160 may be held between the top portion of the button 180 and the lid upper 147. Thus, the seal spring 160 may be biased toward an extended configuration which pushes the button 180 upward which in turn pushes the lid lower 143 upward and toward the lid upper 147. In addition to the seal spring 160, the first container 100 may also include a sleeve spring 170. The sleeve spring 170 may be biased to overcome the attraction between the sleeve magnets 135 and the lid magnets 150. For example, when a force greater than the biasing force of the sleeve spring 170 is applied to sliding the sleeve 130 against this bias (e.g., from a user pushing the sleeve upward), the sleeve spring 170 may be insufficient to move the sleeve 130 back downward to also separate the sleeve magnets 135 from the lid magnets 150 (or decrease the attraction therebetween). However, when the biasing force of the sleeve spring 170 is greatest, the sleeve 130 may be moved automatically back downward such that the sleeve magnets 135 are also moved downward and the attraction between the sleeve magnets 135 and the lid magnets 150 is insufficient to overcome the spring bias of the seal spring 160. Therefore, the first container 100 may be placed back to the closed position in an automatic manner.

It is noted that the sleeve spring 170 may not be required. For example, the sleeve 130 may be of a sufficient mass such that, when in an upright position, gravity may pull the sleeve 130 back downward when no external force (e.g., from the user) is being applied. However, the inclusion of the sleeve spring 170 may ensure that the sleeve 130 moves back to the resting, downward position even when the first container 100 is not in an upright position. In fact, the first container 100 may be upside down and the sleeve spring 170 may be sufficient to also fight against the pull of gravity.

In view of the manner in which the seal spring 160 and the sleeve spring 170 operate with the opening mechanism, the seal spring 160 and the sleeve spring 170 may be selected to have particular characteristics that enable the opening mechanism to be used as intended. For example, the seal spring 160 may provide a spring bias sufficient enough to ensure that all contributing forces (e.g., gravity pull on lid lower 143, attraction between the sleeve magnets 135 and the lid magnets 150 when not in a closest proximity, etc.) do not separate the lid lower 143 from the lid upper 147 and keep these components held against one another in a resting, closed configuration. In another example, the sleeve spring 170 may provide a maximum spring bias sufficient to pull the sleeve 130 back downward but still allow the sleeve 130 to be moved upward even when the first container 100 is empty. In a particular implementation, the seal spring 160 and the sleeve spring 170 may be selected based on an empty weight of the first container 100 and the lid 140 being approximately 350 grams.

The button 180 has already been described above with regard to its contribution with the opening mechanism. The button 180 may also serve an additional functionality. For example, the button 180 may be used in a manual manner for a venting feature to vent steam or pressure that builds up within the first container 100 when it is sealed. For example, when the lid 140 is sealed, steam from a hot liquid within the first container 100 may build up within the first container 100. This build-up of steam may also result in a higher pressure within the drinking container 100 as the same volume is being used to hold additional gas (e.g., Boyle's Law). This higher pressure may prevent the first container 100 from moving to the open configuration (e.g., the lid lower 143 being prevented from moving to the open position) when the sleeve 130 is moved upward because the pressure may be an extra bias against the attraction between the sleeve magnets 135 and the lid magnets 150. Thus, the user may press the button 180 on the lid 140 to cause the steam to vent and the pressure inside the drinking container 100 to lower or reach an equilibrium state, thereby allowing the lid 140 to operate as intended. As will be described in further detail below, the manual venting feature via the button 180 is only exemplary and other types of venting features may be incorporated with the first container 100.

It should be noted that the opening mechanism and the orientation/configuration/direction of travel and sliding as described above are only exemplary. The exemplary embodiments may be modified such that the opening mechanism utilizes the above noted principles of the magnetic feature to move the first container 100 from the closed configuration to the open configuration. In fact, being biased to the closed configuration is also only exemplary and the first container 100 may instead be biased to the open configuration. In another example, the sleeve 130 sliding upward to place the first container 100 in the open configuration is only exemplary. If the sleeve 130 and the sleeve magnets 135 had an indirect relationship where movement of the sleeve 130 in a first direction results in the sleeve magnets 135 moving in a second, opposite direction, the sliding motion may also be opposite to place the first container in the open configuration.

It is again noted that the sleeve magnets 135 and the lid magnets 150 may include any number of discrete magnets that are placed around the periphery of the sleeve 130 and the lid 140, respectively. In a particular modification, the sleeve magnets 135 and/or the lid magnets 150 may also be a single magnet. For example, the single magnet may run in a channel around the periphery of the corresponding sleeve 130 or lid 140. Similarly, the seal spring 160 is shown as single spring while there may be two separate sleeve springs 170 on opposite sides of the sleeve 130. However, the number, disposition, and type of the seal spring 160 and the sleeve spring 170 is only exemplary and the exemplary embodiments may utilize any type, number, and orientation to achieve the proper corresponding spring bias.

The deconstructed view of FIG. 7 shows an exemplary set of components that may be assembled to create the first container 100. However, it is noted that the components described herein are only exemplary and those skilled in the art will understand the various different types of components that may be used and the various different arrangements that may be used to achieve the magnetic feature of moving the first container 100 from a closed configuration to an open configuration. The following also provides exemplary materials and sizes that may be selected for the components. However, much like the components themselves, the materials/sizes are also only exemplary and the exemplary embodiments may utilize different materials/sizes as would be appropriate in providing the opening mechanism based on the magnetic feature.

As shown, the components are described as subcomponents of the container portion 120, the sleeve 130, the lid 140, the sleeve spring 170, and the button 180. The button 180 may include a button body 180-1, a button cap 180-2, and a button pin 130-3. The button body 180-1 may be made of polycarbonate (PC), the button cap 180-2 may be made of acrylonitrile butadiene styrene (ABS), and the button pin 130-3 may be made of stainless steel (SS). The button body 180-1 may correspond to the top portion of the button 180 as described above. Thus, the button body 180-1 may have a substantially U cross-sectional shape where a first end of the seal spring 160 is held. The seal spring 160 may be a SS spring temper 0.6 mm diameter spring. The button pin 180-3 may extend to a component of the lid lower 143 for coupling thereto. The button cap 180-2 may provide a surface in which the button body 180-1 extends to an exterior. As shown, the button pin 180-3 may also be associated with an indicator 400/450. The indicator 400/450 will be described in further detail below with regard to FIGS. 14 and 15.

The lid 140 may include a lid body 140-1, a lid filler 140-2, lid threads 140-3, a seal plate post 140-4, a seal plate 140-5, a seal plate overmold 140-6, a gasket 140-7, another gasket 140-8, and a gasket retainer 140-9. The lid body 140-1, the lid filler 140-2, the lid threads 140-3, the seal plate post 140-4, the seal plate 140-5, the seal plate overmold 140-6, and the gasket retainer 140-9 may all be made of ABS. The gaskets 140-7 may be made of 20 Durometer silicone rubber while the gasket 140-8 may be made of silicone rubber. The lid body 140-1 may form a drinking component of the lid 140 and may include a rounded or contoured edge at a top end to facilitate a user to drink from a direct contact on the first container 100. The lid filler 140-2 may be an additional component included for mechanical assembly purposes. The lid threads 140-3 may be a bottom portion of the lid 140 that allows the lid 140 to be coupled to the container portion 120, specifically to a component of the container portion 120. The lid 140 may also include the lid magnets 150. The lid magnets may be Neodymium N52—high temperature magnets. An exemplary orientation, configuration, and number of the lid magnets 150 is illustrated in FIG. 7.

The remaining assembly of the lid 140 may include the seal plate post 140-4 coupling to the seal plate 140-5 (e.g., via threading) and the seal plate 140-5 coupling to the seal plate overmold 140-6 (e.g., via threading). The seal plate post 140-4 may also be the component noted above as the part of the lid lower 143 to which the button pin 180-3 couples (e.g., via threading). The seal plate 140-5 may represent the part of the lid lower 143 that is pressed against the lid body 140-1 which represents the part of the lid upper 147. With the lid body 140-1 being the lid upper 147 and the seal plate 140-5 being the lid lower 143, the closed configuration may be accomplished by pressing the gasket 140-8 against the gasket 140-9 (both made with silicone rubber). Accordingly, the gasket 140-7 may be coupled to the seal plate 140-5 (e.g., on a top surface) and the gasket 149-8 may be coupled to the lid body 140-1 (e.g., on a bottom surface) using the gasket retainer 140-9.

The container 120 may include a SS inner 120-1, a SS outer 120-2, a SS outer pad 120-3, a collar outer 120-4, a collar inner 120-5, and a collar seal 120-6. The SS inner 120-1 and the SS outer 120-2 may be made with SS. Specifically, the SS of the SS inner 120-1 may be AISI 304 while the SS of the SS outer 120-2 may be 201 annealed SS. In addition, upon assembling the SS inner 120-2 to the SS outer 120-2, a space therebetween may have a vacuum pulled to provide an insulation feature in the container portion 120. The SS outer pad 120-3 may be made of thermoplastic elastomer (TPE) to provide a gripping surface on a bottom side of the first container 100. The collar outer 120-4 and the collar inner 120-5 may be made of ABS while the collar seal 120-6 may be made of silicone rubber. The collar outer 120-4 and the collar inner 120-6 along with the collar seal 120-6 may form an upper lip of the container portion 120. The collar inner 120-5 may also include the opposing threading for the lip threads 140-3 for the lid 140 to couple to the container portion 120.

The sleeve 130 may include a sleeve lock side 130-1, a sleeve solid side 130-2, spring shuttles 130-3, sleeve magnet retainers 130-4, sleeve magnet retainer plugs 130-5, and sleeve pins 130-6. The sleeve lock side 130-1, the sleeve solid side 130-2, the sleeve magnet retainers 130-4, and the sleeve magnet retainer plugs 130-5 may be made of ABS. The spring shuttles 130-3 may be made of Delrin while the sleeve pins 130-6 may be made of SS. In contrast to the assembly of the other components described above which are assembled vertically, the components of the sleeve 130 may be assembled horizontally. Specifically, the sleeve lock side 130-1 may couple to the sleeve solid side 130-2 using the sleeve pins 130-6 over a section of a perimeter of the longitudinal length of the container portion 120. Inside the sleeve lock side 130-1 and the sleeve solid side 130-2, the spring shuttles 130-3 may be positioned with the sleeve springs 170 using sleeve spring retainers 170-1 to facilitate the spring bias of the sleeve spring 170 to be provided from vertical movement of the sleeve 130. The sleeve springs 170 may be a SS spring temper 0.33 mm diameter spring. The sleeve 130 may also include the sleeve magnets 135 using the sleeve magnet retainers 130-4 and the sleeve magnet retainer plugs 130-5. The sleeve magnets 135 may be Neodymium N52 magnets. In addition, the lock 185 may be positioned accordingly with the sleeve lock side 130-1.

It is noted that the circular distribution of the sleeve magnets 135 and the lid magnets 150 may ensure that a proper distance corresponding to the open and closed configurations may be achievable. As the lid 140 uses threading to couple to the container portion 120, there exists possibilities that the magnets 135, 150 may not be properly aligned. However, with the circular distribution, a misalignment may be entirely avoided. It is also noted that if the coupling of the lid 140 to the container portion 120 is controlled, the first container 100 may only utilize a single sleeve magnet 135 and a single lid magnet 150 as the controlled coupling may ensure an alignment of the magnets 135, 150. In another manner, the threading or coupling mechanism for the lid 140 to couple to the container portion 120 may include a stop or detent to only allow a maximum amount of threading or indicate that an intended position has been reached. Accordingly, the stop/detent may provide a tactile indication (e.g., a recognizable click) and/or an audible indication (e.g., an audible click) that the lid 140 has been threaded to the container portion 120 to the intended position. The intended position via the threading and the stop/detent may further provide a proper alignment of the magnets 135, 150.

The above describes the first container 100 and the magnetic feature used in combination with a dual spring feature. Thus, the first container 100 may be biased toward the closed configuration via the seal spring 160 and the sleeve spring 170. When sufficient force is applied to the sleeve 130, the spring bias of the sleeve spring 170 may be overcome to move the sleeve 130 in a stressed direction (e.g., upward along the longitudinal length of the container portion 120). It is noted that the force that may be required to be applied to the sleeve 130 may be accomplished from the user raising the first container 100 while holding the sleeve 130. For example, the weight of the first container, the weight of the liquid in the container (if already holding the liquid), and gravity may provide the necessary force for the sleeve 130 to be moved and overcome the bias of the sleeve spring 170. Once the sleeve 130 has moved a sufficient amount (e.g., the maximum clearance distance d), the sleeve magnets 135 may be within a close enough proximity to the stationary lid magnets 150 such that an attraction created therebetween may be strong enough to overcome the spring bias of the seal spring 160. In this manner, the first container 100 may move to an unbiased open configuration where the lid lower 143 separates from the lid upper 147 and the liquid in the container portion 120 is accessible. For example, tilting the first container 100 may cause the liquid to flow through an access pathway created from the separation of the lid components 143, 147. Thereafter, when the force applied to the sleeve 130 is released, the spring bias of the sleeve spring 170 may take precedence to move the sleeve 130 to a resting position, movement of the sleeve 130 creating a greater distance between the sleeve magnets 135 and the lid magnets 150, the greater distance weakening the attractive force such that the spring bias of the seal spring 160 takes precedence and the lid lower 143 moves back to press against the lid upper 147 for the first container 100 to be in the closed configuration. For example, the user may place the first container 100 back onto a flat surface and release a hold on the sleeve. Accordingly, the weight of the first container and the weight of the liquid may be removed from the force. In addition, gravity provides an opposite effect when the sleeve 130 is released as gravity pulls the sleeve 130 downward. Thus, the force that may be required to automatically revert to the closed configuration may be provided from the user releasing the sleeve 130 (e.g., to place the first container 100 down).

Figure 8:
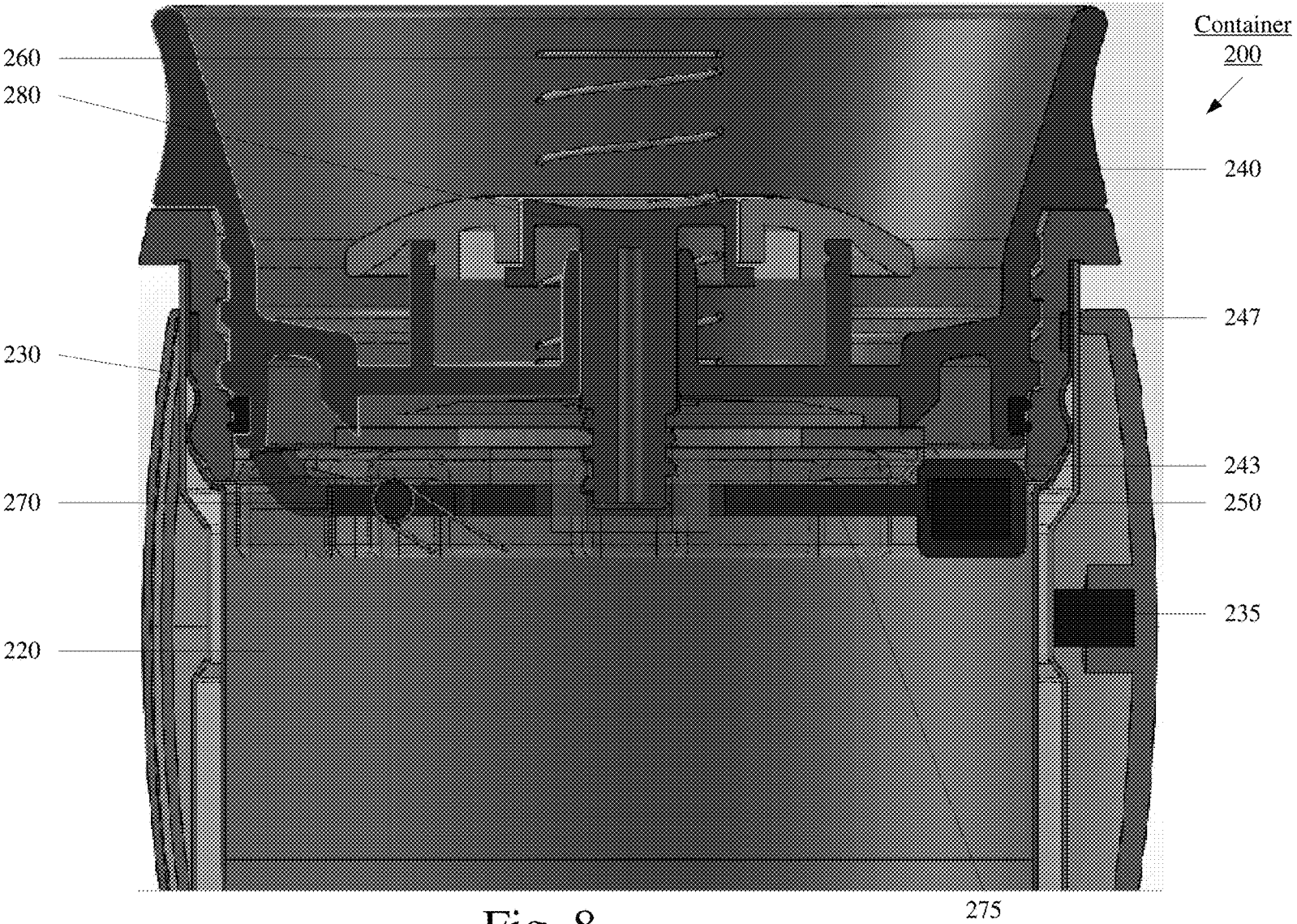
FIG. 8 shows a first cross-sectional view of an example second container according to the exemplary embodiments.
Figure 9:
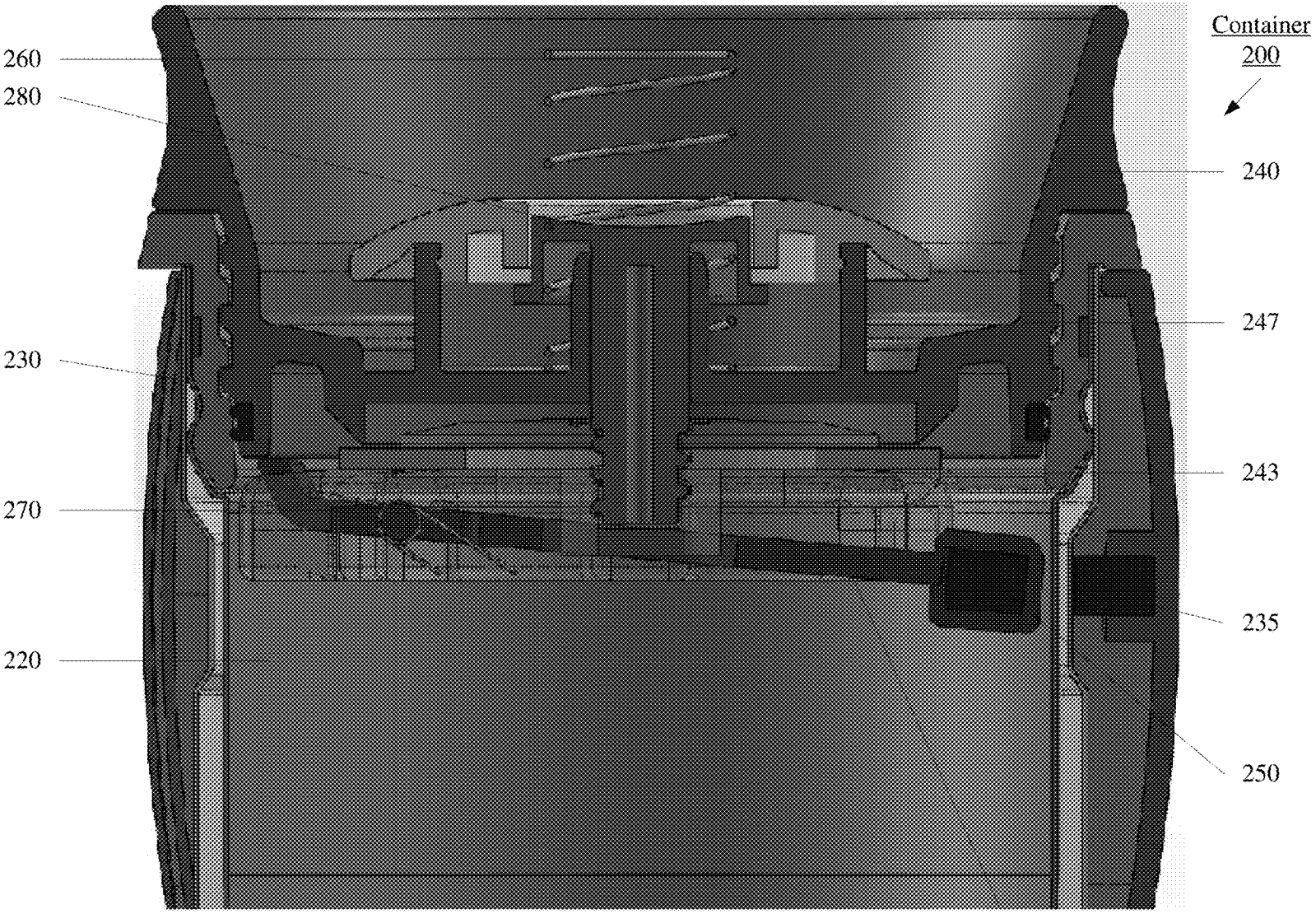
FIG. 9 shows a second cross-sectional view of the example second container of FIG. 2 according to the exemplary embodiments.

FIGS. 8 and 9 show different perspectives of an example second container 200 according to the exemplary embodiments. Specifically, FIG. 8 shows a first cross-sectional view of the second container 200 in a closed configuration and FIG. 9 shows a second cross-sectional view of the second container 200 in an open configuration. The second container 200 may include a feature of a first venting feature. For illustrative purposes, the second container 200 may be substantially similar to the first container 100 except for the inclusion of this first venting feature.

The second container 200 may include a plurality of components and sub-components. Generally, the second container 200 may be substantially similar to the first container 100 with regard to a majority of the components including a container portion 220, a sleeve 230, sleeve magnets 235, a lid 240 including a lid lower 243 and a lid upper 247, lid magnets (not shown), a seal spring 260, and a button 280. Accordingly, the above described materials, configurations, number, orientations, and modifications may also be applied to the second container 200. In contrast to the venting feature of the first container 100 accomplished with a manual actuation of the button 180, the second container 200 utilizes the magnetic feature to further provide an automatic venting of the interior of the container portion 220. Specifically, the second container 200 utilizes a lever 275, a lever spring 270, and a lever magnet 250. As will be described below, the automatic actuation of the first venting feature may be coincident with the opening mechanism. For example, when a user raises the second container 200, the first venting feature and the magnetic feature may be used to place the second container 200 in the open configuration.

According to the exemplary embodiments of the second container 200, the lever 275 may extend from a first free end to a second hinged end. The lever 275 may be a moveable component of the lid lower 243. Much like the first container 100, the lid lower 243 and the lid upper 247 may be sealed against one another while the second container 200 is in the closed configuration, and the lid lower 243 may be separated from the lid upper 247 while the second container 200 is in the open configuration. The lever 275 may be coupled to the lid lower 243 or the lid upper 247 at its hinged end. Thus, when the second container 200 is in the open configuration and the lever 275 is coupled to the lid upper 247, the lever 275 may remain fixed while only the lid lower 243 moves. When the second container 200 is in the open configuration and the lever 275 is coupled to the lid lower 243, the lever 275 may also move with the lid lower 243. The first free end of the lever 275 may include the lever magnet 250. The second hinged end of the lever 275 may include the lever spring 270. As shown in FIG. 8, the lever 275 may extend across a diameter of the interior of the container portion 220. The length of the lever 275 may enable a relatively weaker attractive force to be used to pivot the lever 275 (based on the mechanics of pivot points and levers). Accordingly, the lever magnet 250 may be selected based on the attractive force to pivot the lever 275. However, it is noted that such a configuration is only exemplary and the lever 275 may extend a different distance within the interior of the container portion 200.

The sleeve 230 and the sleeve magnets 235 may be used in a substantially similar manner as the sleeve 130 and the sleeve magnets 135. Specifically, the sleeve 130 may be slidable along a portion of a longitudinal length of the container portion 220. FIG. 8 shows the second container 200 in the closed configuration without any exterior force being applied to the sleeve 230. FIG. 9 shows the second container 200 in the open configuration with an exterior force being applied to the sleeve 230. As shown, by moving the sleeve 230 and the sleeve magnet 235 a particular distance, an attractive force between the lever magnet 250 and the sleeve magnets 235 may overcome the spring bias of the lever spring 270 which biases the lever 275 to a horizontal position (or flush position with the lid lower 243). Accordingly, the lever 275 may be moved or pivoted on its hinged end and angled relative to the lid lower 243 or the lid upper 247 to open a portion of the access pathway. This portion of the access pathway that is opened may allow for pressure to equalize between the interior of the container portion 220 and an exterior environment. The equalization of the pressure may also enable the actuation of the opening mechanism that may be required to overcome the bias to the closed configuration to be decreased to place the second container 200 from the closed configuration to the open configuration. For example, if sufficient pressure is built up inside the container portion 220, the attractive force created between the sleeve magnets 235 and the lid magnets may not be sufficient to separate the lid lower 243 from the lid upper 247. However, release of some of this pressure may allow for the attractive force to overcome the bias to the closed configuration.

It is noted that the inclusion of the lever 275 is only exemplary. In an alternative pivoting mechanism to achieve a substantially similar venting feature, the second container 200 may be configured for the lid lower 243 to pivot (e.g., rather than only a section that is occupied by the lever 275). In such an embodiment, one to three magnets in the lid lower 243 may create an attractive force with one to three magnets in the sleeve 230 or elsewhere in the body of the second container 200 for the lid lower 243 to be pivoted upon movement of the sleeve 230. Accordingly, the lid lower 243 may be pivoted a first amount for the venting feature and may additionally provide the access pathway (e.g., from the pivoting motion or further pivoting motion).

The second container 200 may also include a sleeve spring (not shown) which biases the sleeve 230 to a position corresponding to the closed configuration in a substantially similar manner as the sleeve spring 170. Thus, when the exterior force is released, the sleeve 230 may return to a resting position where the distance between the lid magnet 250 and the sleeve magnet 235 is increased (e.g., via the sleeve spring 170 and/or gravity), the increased distance weakening the attractive force for the lever spring 270 to overcome the attractive force and return the lever 275 to a resting position corresponding to the closed configuration.

It is noted that the manual functionality of the button 280 may also be modified for the second container 200 in view of the use of the lever 275. As noted above, the button 180 may be used manually to release pressure building in the container portion 120. Specifically, the button 180 separates the lid lower 143 from the lid upper 147 to place the first container 100 in the open configuration. In a substantially similar manner, the button 280 may provide a redundant venting mechanism to be used manually to relieve pressure that may be building in the container portion 220. However, since the second container 200 incorporates an automatic venting feature, the manual actuation of the button 280 may also be removed from the design.

The above describes the second container 200 and the magnetic feature used in combination with a dual spring feature and a lever. Thus, the second container 200 may be biased toward the closed configuration via the lever spring 270 and the sleeve spring. When sufficient force is applied to the sleeve 230, the spring bias of the sleeve spring may be overcome to move the sleeve 230 in a stressed direction (e.g., upward along the longitudinal length of the container portion 220). Once the sleeve 230 has moved a sufficient amount (e.g., the maximum clearance distance d), the sleeve magnets 235 may be within a close enough proximity to the lever magnet 250 housed in the free end of the lever 275 such that an attraction created therebetween may be strong enough to overcome the spring bias of the lever spring 270. In this manner, the second container 200 may be vented via opening a portion of the access pathway of the liquid. Release of an excess pressure from within the second container 200 may also allow the lid lower 243 from separating from the lid upper 247 to move the second container 200 to an unbiased open configuration where the liquid in the container portion 220 is accessible. For example; tilting the second container 200 may cause the liquid to flow through an access pathway created from the separation of the lid lower 243 from the lid upper 247. Thereafter, when the force applied to the sleeve 230 is released, the spring bias of the sleeve spring may take precedence to move the sleeve 230 to a resting position, movement of the sleeve 230 creating a greater distance between the sleeve magnets 235 and the lid magnets as well as between the sleeve magnets 235 and the lever magnet 250, the greater distance weakening the attractive force for each combination such that the spring bias of the lever spring 270 and the seal spring 260 takes precedence and the lid lower 243 becomes held against the lid upper 247 for the second container 200 to be in the closed configuration.

Figure 10:
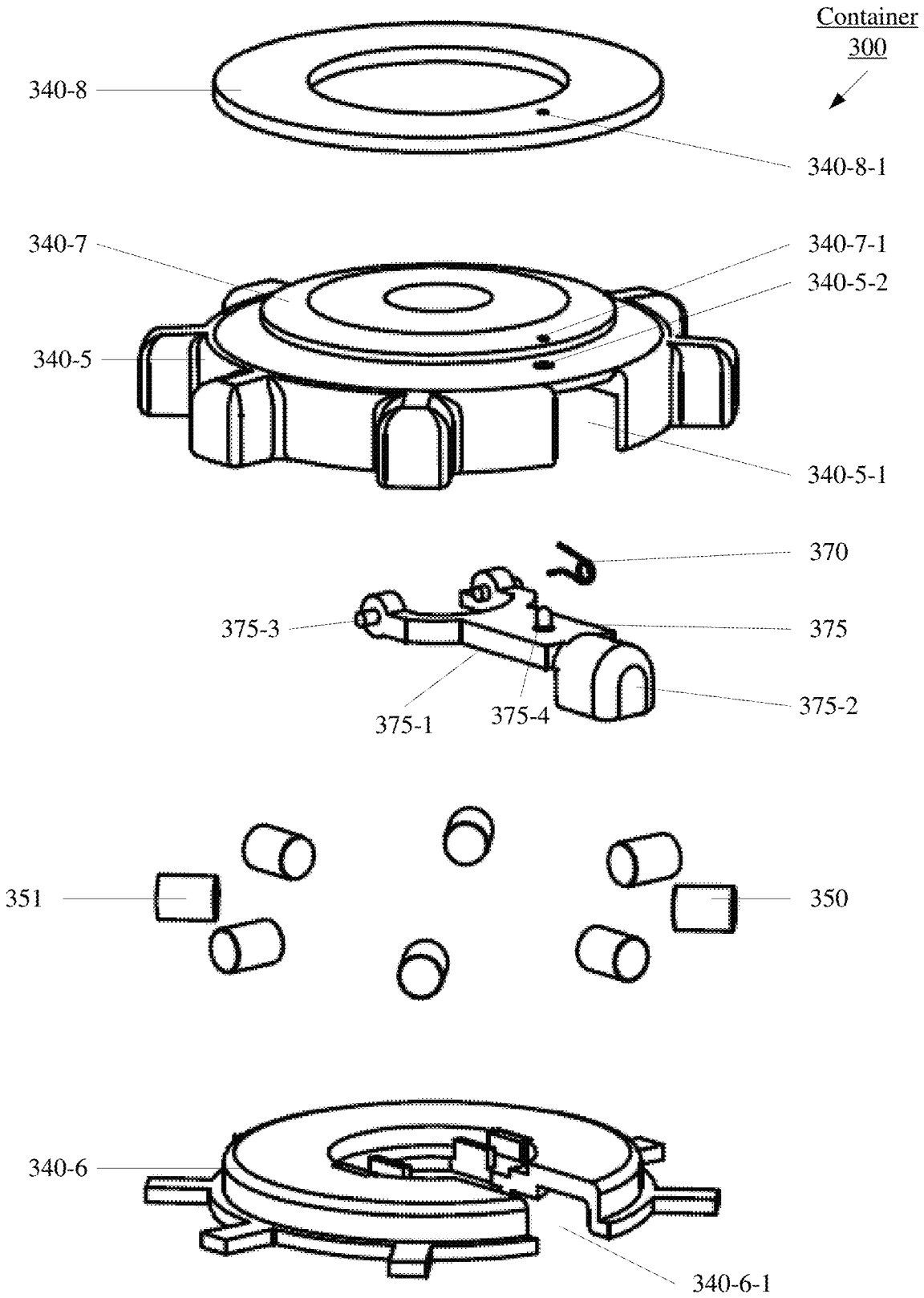
FIG. 10 shows a deconstructed view of an example third container according to the exemplary embodiments.

FIG. 10 shows a deconstructed view of an example third container 300 according to the exemplary embodiments. Specifically, the third container 300 may utilize a second venting feature. The third container 300 may include a feature of a second venting feature. For illustrative purposes, the third container 300 may be substantially similar to the first container 200 except for the inclusion of this second venting feature. Accordingly, the third container 300 may also include a container portion, a sleeve, sleeve magnets, a lid including a lid lower and a lid upper, lid magnets 351, a seal spring, and a button. The deconstructed view of FIG. 10 shows an exemplary set of components that may be assembled to create the third container 300. However, it is noted that the components described herein are only exemplary and those skilled in the art will understand the various different types of components that may be used and the various different arrangements that may be used to achieve the magnetic feature of moving the third container 300 from a closed configuration to an open configuration and utilize the second venting feature.

In contrast to the venting feature of the first container 100 accomplished with a manual actuation of the button 180 and the second venting feature of the second container 200 accomplished using a portion of the access pathway, the third container 300 utilizes the magnetic feature to further provide an automatic venting of the interior of the container portion 220 using a venting pathway. Specifically, the third container 200 utilizes a lever 375, a lever spring 370, a lever magnet 350, and a venting pathway provided through several components. As will be described below, the automatic actuation of the second venting feature may be coincident with the opening mechanism. For example, when a user raises the third container 300, the second venting feature and the magnetic feature may be used to place the third container 300 in the open configuration.

As shown, the components are described as subcomponents of the lid 340. Specifically, the lid 340 may include a gasket 340-8, a gasket 340-7, a seal plate 340-5, lid magnets 350, and a seal plate overmold 340-6. The materials, substantial shape, and functionality may be substantially similar to the gasket 140-7, the seal plate 140-5, the lid magnets 150, and the seal plate overmold 140-6 of the first container 100 with slight modifications. Accordingly, a vertical assembly may be used where the seal plate 340-5 is coupled to the seal plate overmold 340-6. In contrast to the first container 100, the third container 300 utilizes a seal plate 340-5 including a seal plate space 340-5-1. The seal plate overmold 340-6 may also include a seal plate overmold space 340-6-1. As is evident, the spaces 340-5-1 and 340-6-1 may accommodate the lever 375. The seal plate overmold space 340-6-1 may also include an extended space to allow the lever 375 to be flush with the seal plate overmold 340-6 while still allowing a pivoting motion. In addition, the gasket 340-8 may include a hole 340-8-1, the gasket 340-7 may include a hole 340-7-1, and the seal plate 340-5 may include a hole 340-5-2. When assembled, the holes 340-8-1, 340-7-1, and 340-5-2 may be aligned to create the venting pathway from an interior of the container portion to an exterior environment.

The lever 375 is shown as including the lever spring 370, a lever body 375-1, a lever magnet receptacle 375-2, a lever hinge 375-3, and a lever pin 375-4. The lever 375 may be substantially similar in function to the lever 275 of the second container 200. Thus, as described above, the lever 375 may be coupled to the seal plate 340-5 (e.g., the lid upper) and/or the seal plate overmold 340-6 (e.g., the lid lower) via the lever hinge 375-3. The lever spring 370 may also be positioned to pull the lever 375 in the flush, horizontal position corresponding to the closed configuration of the third container 300. The lever magnet receptacle 375-2 may be the free end of the lever body 375-1 that houses one of the lever magnet 350. When the lever 375 is in the resting position from the bias of the lever spring 370, the lever pin 375-4 may block the venting pathway created by the holes 340-8-1, 340-7-1, and 340-5-2. Thus, the venting pathway is not open to the interior of the container portion. However, when the lever 375 is pivoted from the attractive force between the sleeve magnets and the lever magnet 350, the lever 375 may pivot downward in a substantially similar manner as described above with the lever 275 of the second container 200. This pivoting motion moves the lever pin 375-4 out of the venting pathway and opens the venting pathway between the interior of the container portion and the exterior environment, thereby allowing any excess pressure to be released from the interior of the container portion. Thereafter, the attractive force between the sleeve magnets and the lid magnets 351 may separate the lid lower from the lid upper to place the third container in the open configuration.

It is noted that the circular distribution of the lid magnets 351 may ensure that a proper distance corresponding to the open and closed configurations may be achievable relative to the sleeve magnets 335. As the lid 340 uses threading to couple to the container portion 320, there exists possibilities that the magnets 335, 351 may not be properly aligned. However, with the circular distribution, a misalignment may be entirely avoided. It is also noted that if the coupling of the lid 340 to the container portion 320 is controlled, the third container 300 may only utilize a single lid magnet 351 as the controlled coupling may ensure an alignment of the magnets 335, 351.

The above describes the third container 300 and the magnetic feature used in combination with a dual spring feature and a lever. Thus, the third container 300 may be biased toward the closed configuration via the lever spring 370 and the sleeve spring. When sufficient force is applied to the sleeve, the spring bias of the sleeve spring may be overcome to move the sleeve in a stressed direction (e.g., upward along the longitudinal length of the container portion). Once the sleeve has moved a sufficient amount (e.g., the maximum clearance distance d), the sleeve magnets may be within a close enough proximity to the lever magnet 350 housed in the free end of the lever 375 such that an attraction created therebetween may be strong enough to overcome the spring bias of the lever spring 370. In this manner, the third container 300 may be vented via a venting pathway separate from the access pathway of the liquid. Release of an excess pressure from within the third container 300 may also allow the lid lower from separating from the lid upper to move the third container 300 to an unbiased open configuration where the liquid in the container portion is accessible. For example, tilting the second container 200 may cause the liquid to flow through an access pathway created from the separation of the lid lower from the lid upper. Thereafter, when the force applied to the sleeve is released, the spring bias of the sleeve spring may take precedence to move the sleeve to a resting position, movement of the sleeve creating a greater distance between the sleeve magnets and the lid magnets 351 as well as between the sleeve magnets 235 and the lever magnet 350, the greater distance weakening the attractive force for each combination such that the spring bias of the lever spring and the seal spring takes precedence and the lid lower 243 becomes held against the lid upper for the third container 300 to be in the closed configuration.

Figure 11:
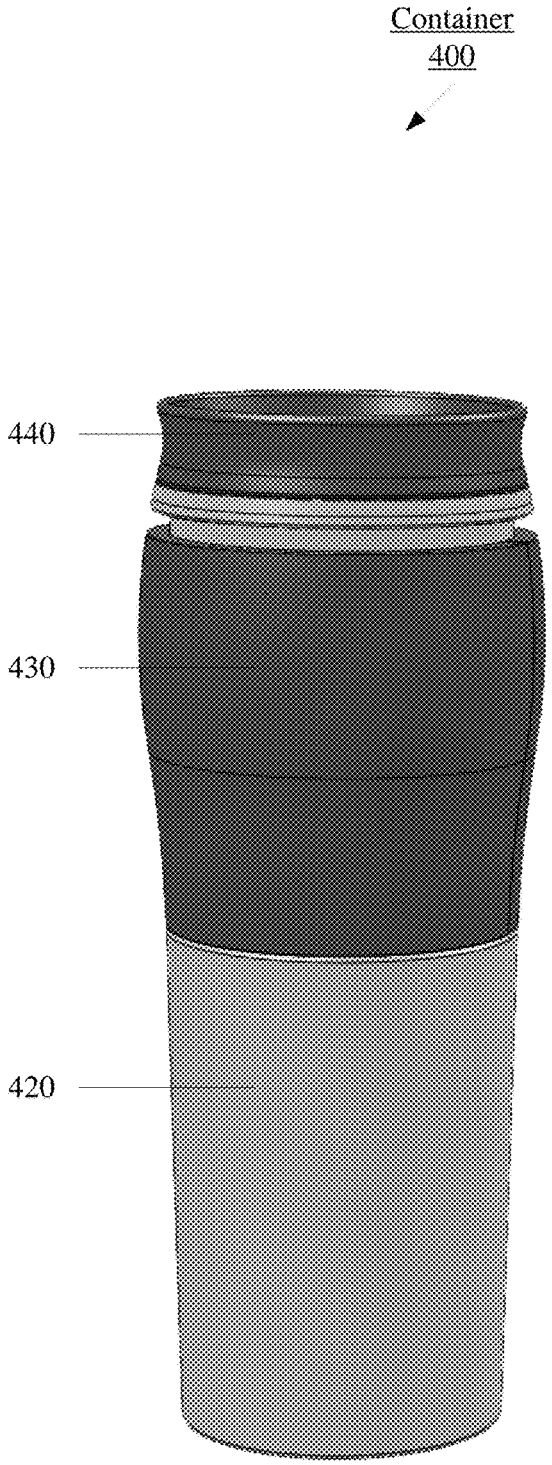
FIG. 11 shows a side view of an example fourth container according to the exemplary embodiments.
Figure 12:
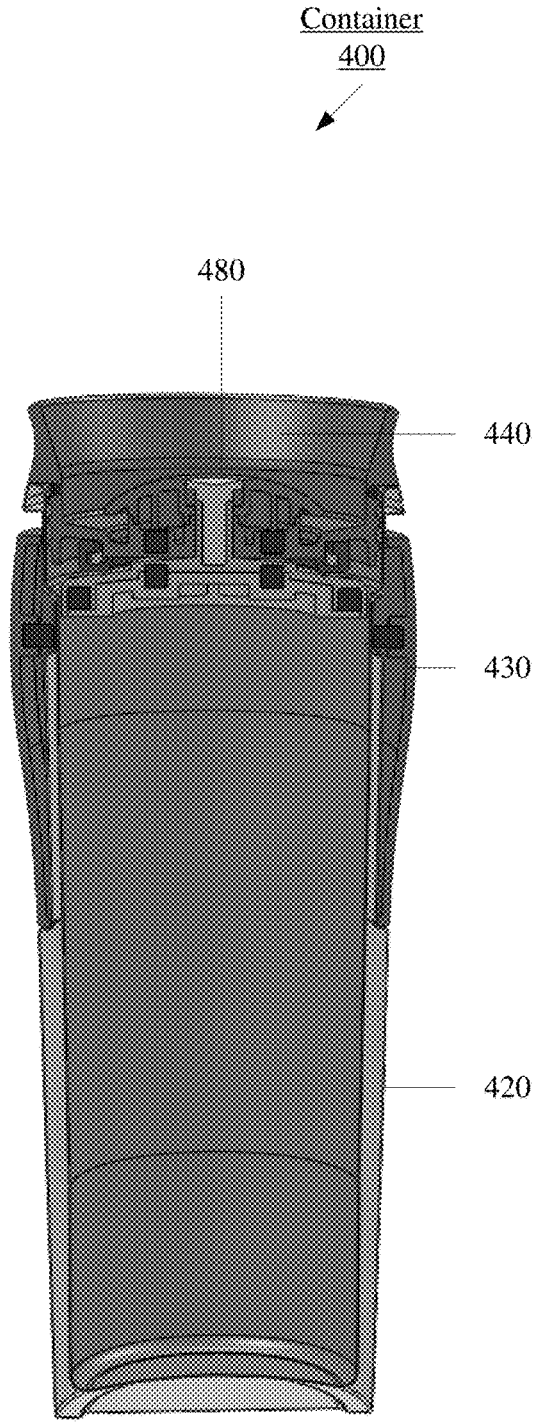
FIG. 12 shows a first cross-sectional view of the example fourth container of FIG. 11 according to the exemplary embodiments.
Figure 13:
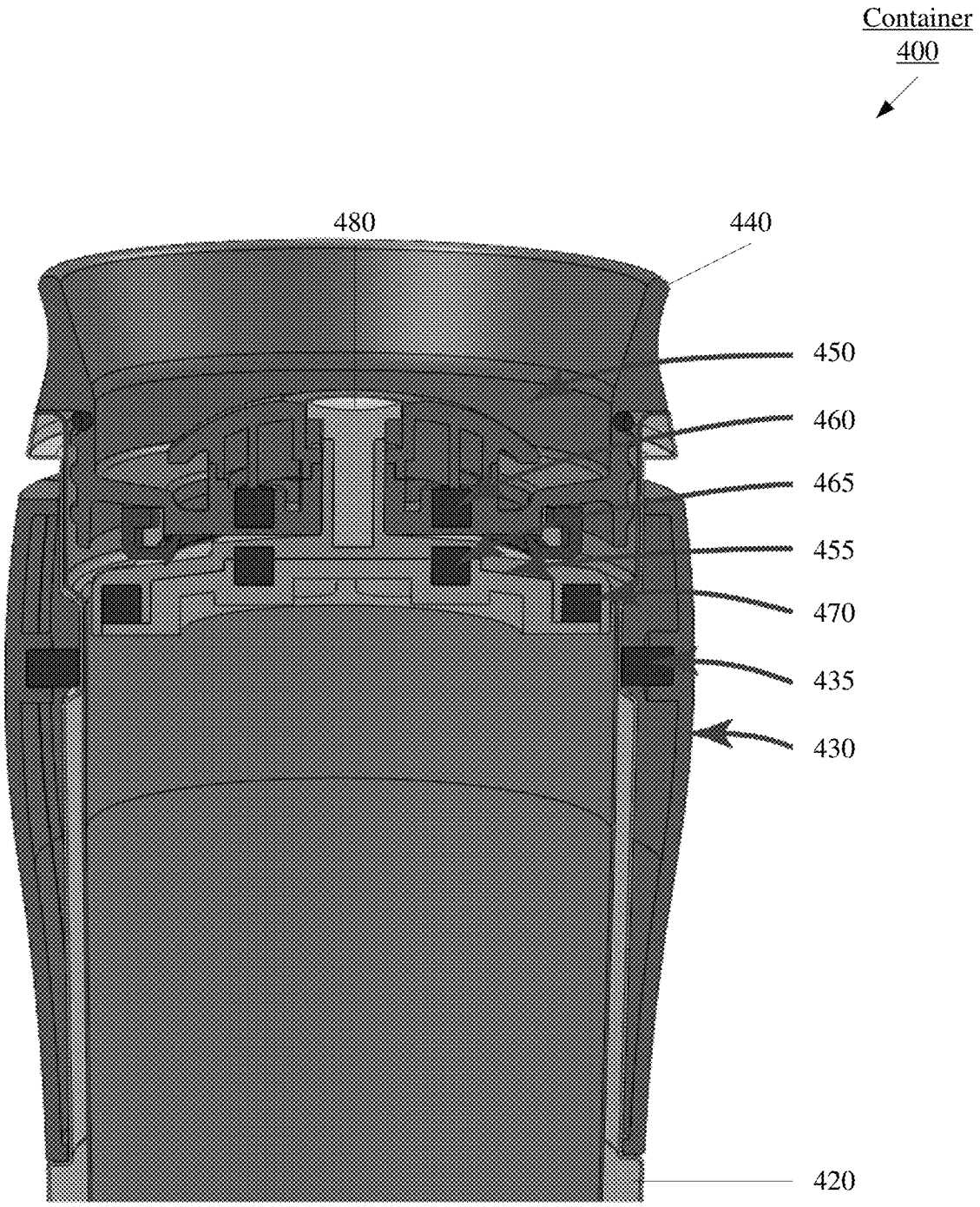
FIG. 13 shows a second cross-sectional view of the example fourth container of FIG. 11 according to the exemplary embodiments.

FIGS. 11-13 show different perspectives of an example fourth container 400 according to the exemplary embodiments. Specifically, FIG. 11 shows an assembled, side view, FIG. 12 shows a first cross-sectional view, and FIG. 13 shows a second cross-sectional view of the example fourth container 400.

The fourth container 400 may include a plurality of components and sub-components. Generally, the fourth container 400 may be substantially similar to the first container 100 with regard to a majority of the components including a container portion 420, a sleeve 430, a lid 440 including a lid lower 455 and a lid upper 450, and a button 480. Accordingly, the above described materials, configurations, number, orientations, and modifications may also be applied to the fourth container 400. In contrast to the opening mechanism of the first container 100, the fourth container 400 utilizes the magnetic feature in a different way. Specifically, the fourth container 400 utilizes a further magnetic feature and replaces the seal spring. However, if the button 480 is also used in a manual manner as described above, a seal spring may also be included with the fourth container 400 but in a different orientation to enable the opening mechanism using the magnetic features of the fourth container 400.

According to the exemplary embodiments of the fourth container 400, the sleeve includes sleeve magnets 435. The lid may include three different sets of magnets. A first set of magnets may be lid outer magnets 470 that operate with the sleeve magnets 435. A second set of magnets may be lid lower magnets 465 located in the lid lower 455 while a third set of magnets may be lid upper magnets 460 located in the lid upper 450. The lid lower magnets 465 and the lid upper magnets 460 may operate with one another and may be more centrally disposed relative to the lid outer magnets 470. The lid lower magnets 465 and the lid upper magnets 460 may be sufficiently separated from the lid outer magnets 470 to prevent any attractive forces therebetween from affecting the attractive force between the lid outer magnets 470 and the sleeve magnets 435. The sleeve 430 and the sleeve magnet 435 may operate in a substantially similar manner as the sleeve 130 and the sleeve magnets 135 of the first container 100. Specifically, the sleeve 430 may be slidable along a section of a longitudinal length of the container portion 420.

The fourth container 400 may be biased toward a closed configuration. Specifically, the sleeve 430 may include a sleeve spring (not shown) that biases the sleeve 430 in a position corresponding to the closed configuration. In this manner, the distance between the lid outer magnets 470 and the sleeve magnets 435 may be maximized and the resulting attractive force therebetween may be weakened. This attractive force may be weaker than the attractive force between the lid upper magnets 460 and the lid lower magnets 465. Thus, in the closed configuration, the attractive force of the lid upper magnets 460 and the lid lower magnets 465 may overpower the attractive force of the lid outer magnets 470 and the sleeve magnets 435.

If an exterior force is applied to the sleeve 430 and the spring bias of the sleeve spring is overcome, the sleeve magnets 435 may be moved closer to the lid outer magnets 470. The closer proximity between the sleeve magnets 435 and the lid outer magnets 470 may increase the attractive force therebetween. In fact, the attractive force may overcome the attractive force between the lid upper magnets 460 and the lid lower magnets 465. Once the attractive force of the lid outer magnets and the sleeve magnets 435 takes precedence, the fourth container 400 may move to the open configuration where the lid lower 455 separates from the lid upper 450 to provide an access pathway to the liquid in the container portion 420.

Once the exterior force is released, the sleeve spring may bias the sleeve 430 to return to a resting position. The sleeve 430 moving may again increase the distance between the sleeve magnets 435 and the lid outer magnets 470 to weaken the attractive force therebetween. The lid upper magnets 460 and the lid lower magnets 465 may again have an attractive force therebetween that takes precedence. Thus, the lid lower 455 may move to a resting position and again press against the lid upper 450 to return the fourth container 400 from the open configuration to the biased closed configuration where the access pathway is sealed.

It is noted that one of the above described venting features may also be incorporated into the fourth container 400. Specifically, the manual venting feature via the button 180, the first automatic venting feature using the lever 275 and a portion of the access pathway, or the second automatic venting feature using the lever 375 and a venting pathway may be incorporated into the fourth container 400.

The above describes the fourth container 400 and the magnetic feature used in combination with a further magnetic feature. Thus, the fourth container 400 may be biased toward the closed configuration via the lid upper magnets 460 and the lid lower magnets 465 as well as the sleeve spring. When sufficient force is applied to the sleeve 430, the spring bias of the sleeve spring may be overcome to move the sleeve 430 in a stressed direction (e.g., upward along the longitudinal length of the container portion 420). Once the sleeve 430 has moved a sufficient amount (e.g., the maximum clearance distance d), the sleeve magnets 435 may be within a close enough proximity to the lid outer magnets 470 such that an attraction created therebetween may be strong enough to overcome the attractive force existing between the lid upper magnets 460 and the lid lower magnets 465. In this manner, the third container 400 may move to an unbiased open configuration where the lid lower 455 separates from the lid upper 450 and the liquid in the container portion 420 is accessible. For example, tilting the third container 400 may cause the liquid to flow through an access pathway created from the separation of the lid lower 355 from the lid upper 450. Thereafter, when the force applied to the sleeve 430 is released, the spring bias of the sleeve spring may take precedence to move the sleeve 430 to a resting position, movement of the sleeve 430 creating a greater distance between the sleeve magnets 435 and the lid outer magnets 470, the greater distance weakening the attractive force such that the attractive force of the lid upper magnets 460 and the lid lower magnets 465 overpowering and taking precedence such that the lid lower 455 moves back and presses against the lid upper 450 for the third container 400 to be in the closed configuration.

Figure 14:
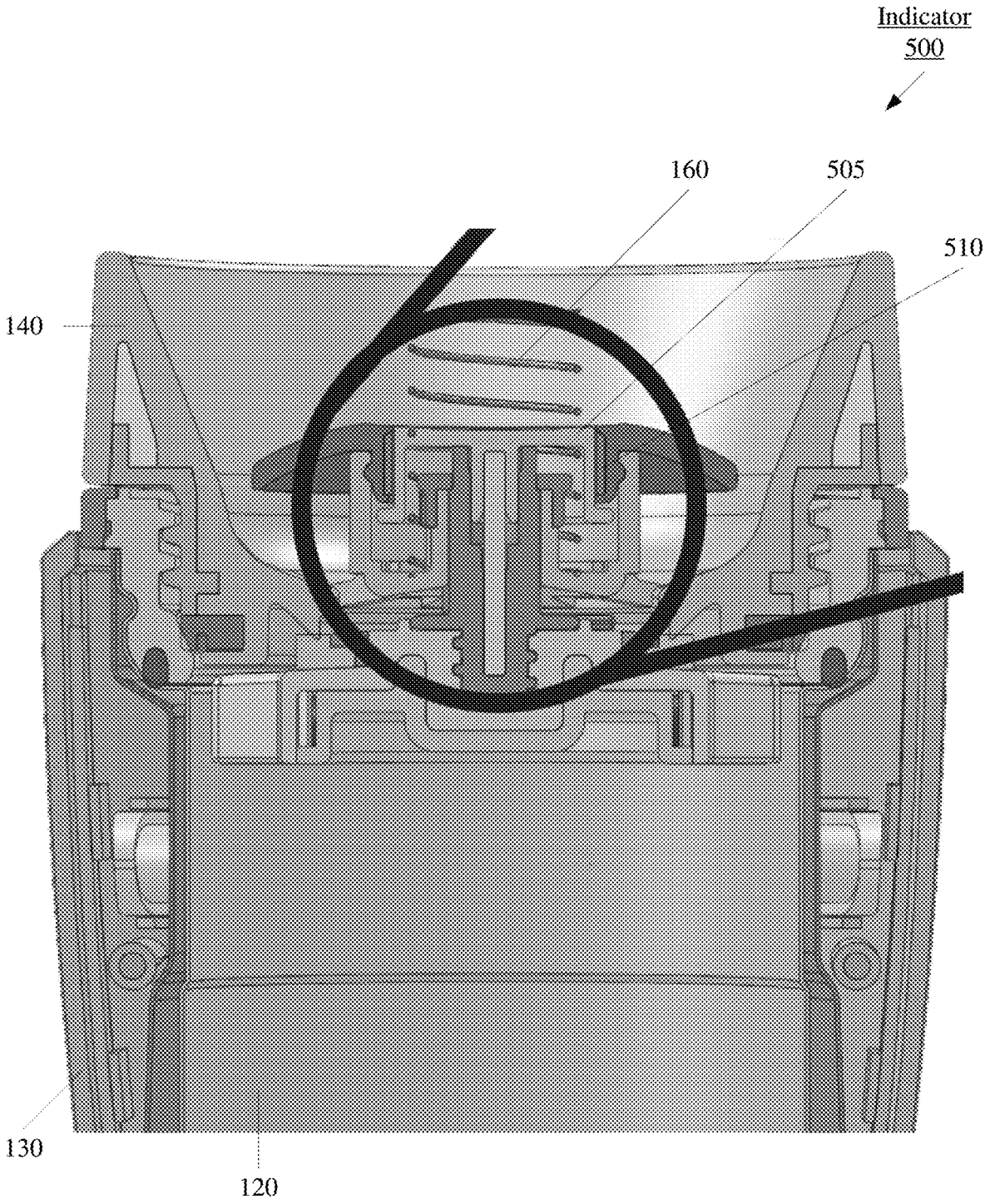
FIG. 14 shows a first example indicator used with the first, second, third, and fourth containers according to the exemplary embodiments.
Figure 15:
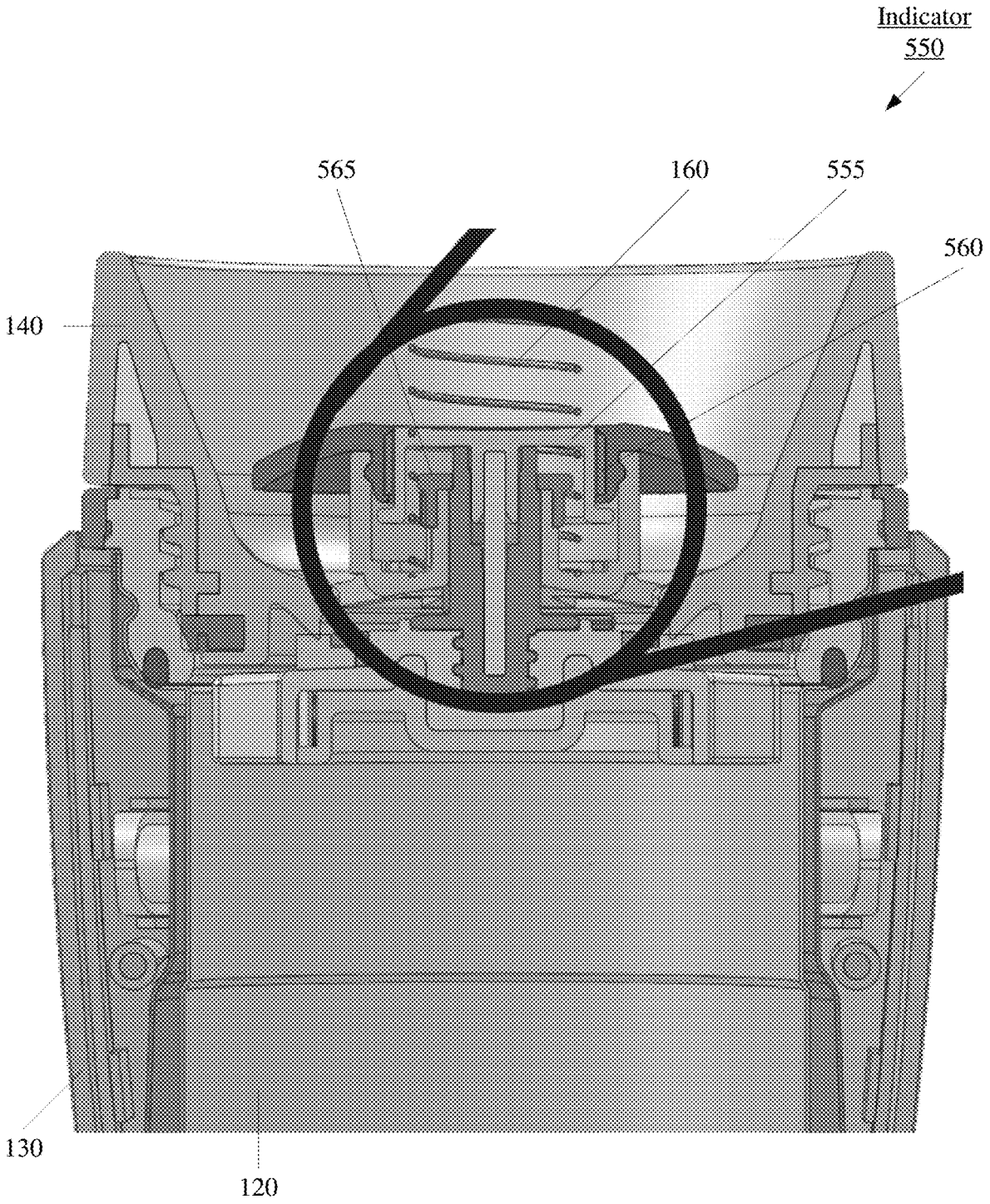
FIG. 15 shows a second example indicator used with the first, second, third, and fourth containers according to the exemplary embodiments.

FIG. 14 shows a first example indicator 500 used with the first container 100, the second container 200, the third container 300, and the fourth container 400 according to the exemplary embodiments. FIG. 15 shows a second example indicator 550 used with the first container 100, the second container 200, the third container 300, and the fourth container 400 according to the exemplary embodiments. The indicators 500, 550 may be used to provide a visual indication to a user as to whether the container is in an open configuration or a closed configuration. For illustrative purpose, the indicators 500, 550 are described with regard to the first container 100. Thus, the indicators 500, 550 are shown with respect to the container portion 120, the sleeve 130, the lid 140, and the seal spring 160. However, those skilled in the art will understand that the indicators 500, 550 may also be used with the second container 200, the third container 300, and the fourth container 400, particularly in view of the buttons.

In the first indicator 500, the button 180 may be modified into an opaque button 505. The opaque button 505 may be configured to block visual access to an indicator ring 510. The indicator ring 510 may be disposed between the opaque button 505 and a button cap. However, depression of the opaque button 505 into the lid 140 may reveal the indicator ring 510. The indicator ring 510 may include a visual indication such as a distinct color (e.g., green) that identifies that the first container 100 is in the open configuration. Absence of the visual indication may identify that the first container 100 is in the closed configuration. Thus, when the lid lower 143 separates from the lid upper 147, the lid lower 143 may move downward which translates to a downward movement of the button 505 (e.g., via button body 180-1 coupled to the button pin 180-3 which is coupled to the seal plate post 140-4 which is coupled to the seal plate 140-5 which corresponds to the lid lower 143). The opaque button 505 being depressed reveals the indicator ring 510 and the visual indication is visible.

In the second indicator 550, the button 180 may be modified into a clear button 555. The clear button 555 may have a texture on the bottom surface of the button. The clear button 555 may be sufficiently separated from an indicator surface 565 lying underneath the clear button 555 at a distance where the indicator surface 565 is not visible while the first container 100 is in the closed configuration. The second indicator 550 may also include an indicator ring 560 in a substantially similar position as the indicator ring 510. However, the indicator ring 560 may have a neutral color or highlight the visual indication of the indicator surface 565. Depression of the clear button 555 into the lid 140 may reveal the indicator surface 565. The indicator surface 565 may include a visual indication such as a distinct color (e.g., green) that identifies that the first container 100 is in the open configuration. Absence of the visual indication may identify that the first container 100 is in the closed configuration. Thus, when the lid lower 143 separates from the lid upper 147, the lid lower 143 may move downward which translates to a downward movement of the button 555 (e.g., via button body 180-1 coupled to the button pin 180-3 which is coupled to the seal plate post 140-4 which is coupled to the seal plate 140-5 which corresponds to the lid lower 143). The clear button 555 being depressed moves closer to the indicator surface 565 such that the visual indication is visible. The texture on the bottom surface of the clear button 555 may be configured to diffuse the color of the indicator surface 565 so that the color reflects inside the clear button 455, thereby filling the clear button 555 with color.

The indicators 500, 550 may also be used to show a visual indication of when the first container 100 is in the closed configuration. For example, while in the closed configuration, the indicators 500, 550 may show a visual indication or color (e.g., red) that the first container 100 is closed. When the first container 100 is in the open configuration, the visual indication may become hidden. In another example, the indicators 500, 550 may show a corresponding visual indication for both the open configuration (e.g., green color) and the closed configuration (e.g., red color).

The exemplary embodiments provide a drinking container that provides an automatic lid closing mechanism. By holding the drinking container at a particular location, the drinking container may automatically open, and by releasing the drinking container, the drinking container may automatically close. This may be the extent of any exterior force that is required by the exemplary embodiments. The closing mechanism also corresponds to an opening mechanism that utilizes a magnetic feature. In a first exemplary embodiment, an exterior force on a sleeve creates an attractive force in the magnetic feature that overpowers a spring bias to separate lid components to move the container from a biased closed configuration to a stressed open configuration. In a second and third exemplary embodiment, a first and second venting feature, respectively, may be incorporated to pivot a lever that exposes an interior of the container that may have pressure built up to an exterior for the pressure to be released. In the first venting feature, the pressure may be released via a portion of the access pathway of the container. In the second venting feature, the pressure may be released via a venting pathway. Through the pressure release, the attractive force in the magnetic feature may overpower or more easily overpower the spring bias to separate the lid components to move the container from a biased closed configuration to a stressed open configuration. In a fourth exemplary embodiment, an exterior force on a sleeve creates an attractive force in the magnetic feature that overpowers a further attractive force to separate lid components to move the container from a biased closed configuration to a stressed open configuration. The exemplary embodiments also incorporate an indicator feature to show a state of the container—between an open configuration from visibility of an indication and a closed configuration from absence of the indication (or vice versa).

It will be apparent to those skilled in the art that various modifications may be made in the present invention, without departing from the spirit or the scope of the invention. Thus, it is intended that the present invention cover modifications and variations of this invention provided they come within the scope of the appended claims and their equivalent.

What is claimed is:

1. A drinking container, comprising:

a container portion;

a sleeve that is moveable between a closed position and an open position with respect to the container portion, the sleeve including a sleeve magnet;

a lid that is moveable from a closed configuration to an open configuration, the lid including a lid magnet, the closed position of the sleeve corresponding to the closed configuration of the lid sealing an access pathway to an interior of the container portion, the open position of the sleeve corresponding to the open configuration of the lid opening the access pathway to the interior of the container portion, wherein, in the closed position of the sleeve, a biased force holds the lid in the closed configuration, wherein the lid comprises a seal spring at least partially enclosed within a body of the lid, the seal spring generating the biased force, wherein, in the open position of the sleeve, the sleeve magnet and the lid magnet have a magnetic force greater than the biased force to place the lid in the open configuration; and a button configured to be manually depressed from a resting position to a stressed position, the button in the stressed position placing the lid in the open configuration to relieve a pressure from the interior of the container portion.

2. The drinking container of claim 1, wherein the sleeve includes a sleeve spring generating a further biased force to move the sleeve to the closed position.

3. The drinking container of claim 2, wherein the sleeve is moveable to the open position from an exterior force greater than the further biased force of the sleeve spring.

4. The drinking container of claim 2, wherein the sleeve magnet remains below the lid magnet when the sleeve is in the closed position and the open position.

5. The drinking container of claim 1, wherein the biased force biases a lid lower of the lid to be pressed against a lid upper of the lid.

6. The drinking container of claim 1, wherein the seal spring biases the button to the resting position.

7. The drinking container of claim 1, further comprising:

a visual indicator identifying when the lid is in the open configuration or the closed configuration.

8. The drinking container of claim 7, wherein the button is opaque, wherein the visual indicator is an indicator ring hidden while the button is in the resting position, and wherein the button being depressed reveals the indicator ring.

9. The drinking container of claim 7, wherein the button is clear, wherein the visual indicator is an indicator surface hidden while the button is in the resting position, and wherein the button being depressed reveals the indicator surface.

10. The drinking container of claim 1, wherein the lid includes a hinged lever, the biased force holding the hinged lever in a first angular disposition.

11. The drinking container of claim 10, wherein the lid includes a lever spring generating a further biased force on the hinged lever.

12. The drinking container of claim 11, wherein the magnetic force overcomes the biased force to pivot the hinged lever to a second angular disposition.

13. The drinking container of claim 11, wherein the hinged lever being in the second angular disposition one of opens a portion of the access pathway or opens a venting pathway through a lid upper of the lid.

14. The drinking container of claim 1, wherein the lid additionally includes an upper lid magnet and a lower lid magnet, the upper lid magnet and the lower lid magnet generating a further magnetic force, the further magnetic force being the biased force.

15. The drinking container of claim 14, wherein the biased force biases a lid lower of the lid to be pressed against a lid upper of the lid.

16. The drinking container of claim 1, further comprising:

a manually actuated lock configured to hold the sleeve in one of the close position or the open position.

17. A drinking container, comprising:

a container portion;

a sleeve that is moveable between a closed position and an open position with respect to the container portion, the sleeve including a sleeve magnet;

a lid that is moveable from a closed configuration to an open configuration, the lid including a lid magnet, the closed position of the sleeve corresponding to the closed configuration of the lid scaling an access pathway to an interior of the container portion, the open position of the sleeve corresponding to the open configuration of the lid opening the access pathway to the interior of the container portion, the lid including a lid upper and a lid lower, the lid lower being separated from the lid upper in the open configuration, the lid lower being held against the lid upper in the closed configuration, wherein, in the closed position of the sleeve, a spring force biases the lid in the closed configuration, wherein the lid comprises a seal spring at least partially enclosed within a body of the lid, the seal spring generating the spring force, wherein, in the open position of the sleeve, the sleeve magnet and the lid magnet have a magnetic force greater than the biased force to place the lid in the open configuration; and a button configured to be manually depressed from a resting position to a stressed position, the button in the stressed position placing the lid in the open configuration to relieve a pressure from the interior of the container portion.

* * * * *